US006260443B1

(12) United States Patent
Spirer

(10) Patent No.: US 6,260,443 B1
(45) Date of Patent: Jul. 17, 2001

(54) HAND WRENCH WITH TORQUE AUGMENTING MEANS

(76) Inventor: Steven E. Spirer, 391 Haworth Ave., Haworth, NJ (US) 07641

( * ) Notice: Subject to any disclaimer, the term of this patent is extended or adjusted under 35 U.S.C. 154(b) by 0 days.

(21) Appl. No.: 09/242,602

(22) PCT Filed: Nov. 4, 1998

(86) PCT No.: PCT/US98/23425

§ 371 Date: Feb. 19, 1999

§ 102(e) Date: Feb. 19, 1999

(87) PCT Pub. No.: WO99/24224

PCT Pub. Date: May 20, 1999

Related U.S. Application Data

(63) Continuation-in-part of application No. 08/976,814, filed on Nov. 24, 1997, which is a continuation-in-part of application No. 08/965,546, filed on Nov. 6, 1997, now Pat. No. 5,953,966.

(51) Int. Cl.[7] ..... B25B 13/46

(52) U.S. Cl. ..... 81/57.39; 81/57.3

(58) Field of Search ..... 81/57.39, 58, 60, 81/57.42, 57.3, 62

(56) References Cited

U.S. PATENT DOCUMENTS

| | | |
|---|---|---|
| 1,327,991 | 1/1920 | Gatewood . |
| 1,346,505 | 7/1920 | Mitchell . |
| 1,522,839 | 1/1925 | Rogers . |
| 2,204,800 | 6/1940 | Freeborn . |
| 2,235,192 | 3/1941 | Bailey . |
| 2,238,125 | 4/1941 | Murray . |
| 2,292,079 | 8/1942 | Joyce . |
| 2,296,532 | 9/1942 | Mekeel, Jr. . |
| 2,653,489 | 9/1953 | Charpentier . |
| 2,655,015 | 10/1953 | Linder . |
| 2,742,797 | 4/1956 | Perham . |
| 2,783,657 | 3/1957 | Kohlhagen . |
| 2,882,757 | 4/1959 | Edsall . |
| 3,363,482 | 1/1968 | Case . |
| 3,364,794 | 1/1968 | Ishioka . |

(List continued on next page.)

FOREIGN PATENT DOCUMENTS

| | | | | |
|---|---|---|---|---|
| 3334 618 | * | 3/1984 | (DE) | 81/57.39 |
| 0035 165 | * | 9/1981 | (EP) | 81/57.39 |

*Primary Examiner*—James G. Smith
*Assistant Examiner*—Hadi Shakeri
(74) *Attorney, Agent, or Firm*—Weingram & Associates, P.C.

(57) ABSTRACT

A wrench (10) with torque augmenter is provided which includes a linkage assembly (38) to join a drive input (46) with an output wrench socket (90). The linkage assembly (38) consists of a drive link (40) extending from the input socket (46) and coacting with a conversion link (42) extending to a ratchet (88) disposed about the output socket (90) of the wrench. Rotation of the drive link (40) pivots the conversion link (42) to transfer torque from the input to the output socket (90). A pawl (76) on the driven link (42) is provided to coact with the ratchet (88) which encircles the output socket (90). A guide (36) is disposed at the interior of the housing (12) for the wrench to coact with the linkage assembly (38) and maintain proper alignment during a torque operation, such that stress and force are substantially reduced or dissipated, if not eliminated, during the operation. Another embodiment (310) of the wrench includes a pair of sockets (312,314) interconnected with a drive link assembly (316) to which a pair of springs (348,350) are operatively associated. This embodiment (310) is for use with an impact type wrench (380) and automatically recycles itself for a subsequent torque operation during the intermittent lulls of the torque cycle of the impact wrench. Other embodiments (600,700,800) of the hand wrench are constructed with internal self-contained hydraulic systems (664) to provide torque augmentation.

22 Claims, 17 Drawing Sheets

U.S. PATENT DOCUMENTS

| | | | | |
|---|---|---|---|---|
| 3,447,404 | | 6/1969 | Lachance . | |
| 3,564,953 | | 2/1971 | Able . | |
| 3,722,325 | | 3/1973 | Rogers . | |
| 4,041,835 | | 8/1977 | Isler . | |
| 4,063,475 | | 12/1977 | Perkins . | |
| 4,098,151 | * | 7/1978 | Bliss | 81/57.3 |
| 4,339,968 | * | 7/1982 | Krieger | 81/57.39 |
| 4,479,553 | * | 10/1984 | Virgili | 173/168 |
| 5,450,773 | * | 9/1995 | Darrah et al. | 81/57.39 |
| 5,584,220 | | 12/1996 | Darrah et al. . | |
| 5,732,605 | | 3/1998 | Mann . | |

* cited by examiner

HAND WRENCH WITH TORQUE AUGMENTING MEANS

CROSS REFERENCE TO RELATED APPLICATIONS

This application is a 35 U.S.C. 371 application of PCT/US98/23425 filed Nov. 4, 1998 and a continuation-in-part of U.S. application Ser. No. 08/976,814 filed Nov. 24, 1997, which is a continuation-in-part of U.S. application Ser. No. 08/965,546 filed Nov. 6, 1997, U.S. Pat. No. 5,953,966. The disclosure of U.S. application Ser. Nos. 08/976,814 and 08/965,546, are hereby incorporated by reference.

BACKGROUND OF THE INVENTION

1. Field of the Invention

The present invention relates to torquing apparatus and in particular, to hand operated apparatus adapted to transmit and/or augment torque from an input through to an output of the apparatus. Additionally, the invention relates to a device which is especially adaptable for use with pulsating torque apparatus such as impact tools or other external torque providing apparatus.

2. Description of the Related Art

Wrenches are among the most useful hand tools and their design often have conflicting objects. The primary purpose of a wrench is to apply torque to a nut or other fastening device to seat or unseat the device in threaded engagement with a mating object. In order to apply large amounts of torque, wrenches normally have to be either very large in size or use auxiliary mechanisms such as hydraulic or mechanical apparatus to increase the torque provided by the wrench. This tends to make the wrench bulky and large and limit its effectiveness for normal everyday use where the object is to provide a wrench that is relatively small, can fit into tight places and is easy and convenient to use. Examples of torque augmenting devices are known and disclosed in the prior art as follows:

| U.S. Pat. No. | Inventor(s) |
|---|---|
| 1,522,839 | Rogers |
| 2,204,800 | Freeborn |
| 2,235,192 | Bailey |
| 2,238,125 | Murray |
| 2,292,079 | Joyce |
| 2,296,532 | Mekeel, Jr. |
| 2,653,489 | Charpentier |
| 2,655,015 | Linder |
| 2,742,797 | Perham |
| 2,783,657 | Kohlhagen |
| 2,882,757 | Edsall |
| 3,363,482 | Case |
| 3,364,794 | Ishoika |
| 3,722,325 | Rogers |
| 4,041,835 | Isler |

For example, U.S. Pat. No. 2,296,532 to Mekeel. Jr. discloses a torque control transmission having a reaction brake which includes a ratchet wheel and latch, and a reversing brake with oppositely facing ratchet wheel and latch. Connector arms support the latches and are pivotally operated by a lever.

U.S. Pat. No. 2,783,657 to Kohlhaaen discloses a constant torque drive having a plurality of gears arranged between a pair of plates, and a pawl pivotally mounted on one of the gears and urged by a spring into operative engagement with a disc-shaped head of a stud to lock the gears against counterclockwise rotation, but permit their rotation in a clockwise direction. The gears are supported by an arm which is connected to a spring to urge the arm in a certain direction.

U.S. Pat. No. 3,364,794 to Ishoika discloses a spring torque converter having a plurality of rocking levers, pairs of which are connected with links for coaction with the drive shaft and driven shaft to apply torque. Another embodiment discloses a plurality of crank pins, and a helical spring having one end attached to the respective crank pin and another end attached to an anchoring pin on a carrier portion of the device.

The remaining patents also disclose other torquing devices.

There are also the instances where a wrench is required for use in a torque operation under water. Sometimes, the torquing operation occurs at substantial depths for prolonged period of time. The operation may occur over a substantially large area requiring the user of the wrench to move to the different cites that the torquing operation is to occur. In those instances, with devices requiring hydraulic lines, the amount of pressure necessary to be increased at the surface to convey the pressure through the line must be carefully monitored and controlled.

In addition, the hydraulic line snaking downward through the water to the torque wrench is cumbersome and with increased length difficult to move about a large area under water. There is also the possibility of entanglement of the hydraulic line and where ruptures occur, a substantial amount of hydraulic fluid could be caused to be leaked into the water thereby fouling the environment in violation of federal and state statutes.

OBJECTS AND SUMMARY OF THE INVENTION

The present invention provides a simple, efficient and light weight wrench with torque augmenting means, consisting of a socket wrench which utilizes a rachet arrangement and which includes additional features within the handle of the wrench that enable an auxiliary unit to be connected to the wrench to augment the torque provided by the wrench when situations requiring high torque are encountered. The wrench apparatus is constructed in a manner to facilitate effective coaction of the various components without placing undue stress on the housing and handle of the wrench which enables the wrench to be relatively small for the job it can perform and relatively light and easy to use.

In another embodiment of the invention, the wrench apparatus has two power delivery sockets or driving sockets, one at either end and is relatively symmetrical. The driving sockets can be used for related sizes of nuts that would be used with the device, or for dissimilar shaped fasteners of comparable size. A central driven aperture disposed between the two power delivery sockets has opposed driving fingers extending toward either end of the device to coact with driven arms in the same manner as the single driven aperture hand wrench previously discussed. Spring means are incorporated within the housing to return a middle link, known as the MISSING LINK™, which has opposed driving fingers to an initial position to enhance coaction between the device and an external periodic type of power delivery apparatus, such as an impact wrench.

In a further embodiment of the present invention, the apparatus is constructed with an internal hydraulic assembly connected to a reservoir external to the apparatus for applying torque to a drive output of the wrench.

In still another embodiment of the present invention the wrench is provided with an internal hydraulic assembly, including the hydraulic reservoir, so that the wrench is completely self-contained for applying torque to a drive output.

It is an object of the present invention to provide an augmenter which can be used in confined spaces, and has an envelope sized approximately the same as a standard wrench socket to fit in an area between adjacent nuts.

It is another object of the present invention to provide a hand wrench augmenter which can operate as a hand wrench or as a plain wrench without any force augmentation.

It is another object of the present invention to provide a hand wrench having means to enable additional torque to be transmitted to the hand wrench, which in turn is converted to torque at the wrench engaging portion of the apparatus to augment the total torque that can be exerted by the wrench.

It is another object to the present invention to provide a hand wrench with torque augmenting means which can function either as a hand wrench or as a high torque tightening apparatus of limited travel independently of each other.

It is another object of the present invention to provide a hand wrench augmenter which can be augmented in multiple positions and from either side.

It is an object of the present invention to provide a hand wrench which is adapted for use with a separate input drive to transmit torque to an output drive such as a socket.

It is another object of the present invention to provide a hand wrench which is of simple construction, easy to maintain and repair, and adapted to receive differently sized input drives to transmit torque to the output drive.

It is another object of the present invention to provide a hand wrench constructed with linkage to transmit and convert the torque at the input receptacle to the output drive.

It is another object of the present invention to provide a hand wrench which is operable without external gears or hydraulics.

It is another object of the present invention to provide a hand wrench constructed with a housing in which a guide means is disposed to substantially reduce, if not eliminate, forces at an interior portion of the housing and the linkage within the housing, such that the structural integrity of the housing is maintained.

It is another object of the present invention to provide a hand wrench constructed with a housing having side walls arranged to absorb the force of the internal linkage during an operation of the apparatus.

It is another object of the present invention to provide a hand wrench having a housing in which a biasing means is arranged to automatically urge the linkage to reset for a subsequent torque transmission/augmenting operation.

It is another object of the present invention to provide a hand wrench having a pair of sockets of different sizes at opposed ends of the hand wrench.

It is another object of the present invention to provide a hand wrench adapted to coact with the drive member of an external torquing member such as an impact wrench.

It is another object of the present invention to provide a wrench with a linkage assembly constructed and arranged to interconnect a pair of drive socket assemblies for coaction therewith during a torquing operation.

It is another object of the present invention to provide a wrench with a housing sealed for containing lubricating means therein for elements of the wrench.

It is another object of the present invention to provide a wrench containing linkage means adapted to coact with a repetitive external torque source, to enable coaction between the internal linkage of the wrench and the external pulsating impact torque source.

It is another object of the present invention to provide a wrench with an internal linkage assembly adapted for use with compression springs or leaf springs to initialize the wrench during repetitive cycles.

It is another object of the present invention to provide a wrench with an augmenting means constructed and arranged within a housing of the wrench to automatically reset for a torque augmenting cycle during a lull in operation of a coacting impact wrench.

It is another object of the present invention to provide a wrench having a torque augmenting means adapted to coact with an intermittent cycle of an impact wrench.

It is another object of the present invention to provide a wrench adapted to coact with an external source of cyclic torque.

It is another object of the present invention to provide a wrench which is relatively lightweight, relatively durable, and of simplified construction.

It is another object of the present invention to provide a wrench constructed to minimize the size of the driving sockets of the apparatus to enable the apparatus to be positioned in areas not easily accessible by an external pulsating torque source.

It is another object of the present invention to provide a wrench relatively inexpensive to fabricate, and which can be produced in a wide range of sizes to fit fasteners of relatively small sizes up to relatively large sizes exceeding 6" in diameter.

It is another object of the present invention to provide a wrench having a torque augmenting means operated hydraulically.

It is another object of the present invention to provide a wrench having a hydraulic assembly incorporated therein which is adapted for connection to an external hydraulic source and pump.

It is another object of the present invention to provide a wrench having a torque augmenting means with a built-in hydraulic assembly, including a hydraulic reservoir.

It is another object of the present invention to provide a wrench having a hydraulic torque augmenting means incorporated therein for the wrench to be completely self-contained.

It is another object of the present invention to provide a wrench having a torque augmenting means hydraulically operated and including a pressure gauge as part of the wrench.

It is another object of the present invention to provide a wrench having a hydraulic torque augmenting means which is adapted to receive a hand ratchet or an impact wrench to drive the wrench.

It is another object of the present invention to provide a wrench having a self-contained torque augmenting means which is hermetically sealed for use under water.

It is another object of the present invention to provide a wrench having a hydraulic torque augmenting means of which a cylinder, piston and reservoir for the hydraulics are constructed as an assembled unit for the wrench.

It is another object of the present invention to provide a wrench having a hydraulic torque augmenting means and a pressure gauge therefor, which pressure gauge swivels for orientation to facilitate reading of the gauge during torquing operations.

It is another object of the present invention to provide a wrench having at least one adjustable friction control member to engage an output ratchet of the wrench to prevent the ratchet from slipping during the initial tightening of the ratchet.

It is another object of the present invention to provide a wrench constructed with input and output drives adapted to be mated with other wrench drives so that the wrenches can be ganged.

It is another object of the present invention to provide a wrench having an internal hydraulic assembly with a valve to vent air into the system so that the wrench can be used with an impact wrench or hand wrench.

It is another object of the present invention to provide a wrench having internal elements adapted to be adjusted for a speed versus torque relationship for the wrench.

It is another object of the present invention to provide a wrench having a torque augmenting means wherein the input drive and output drive are arranged along a center line for the wrench.

It is another object of the present invention to provide a wrench having an internal hydraulic torque assembly connected to a quick disconnect valve coupling at an exterior of the wrench for coupling to a hydraulic source.

It is another object of the present invention to provide a wrench having an internal hydraulic torque augmenting means having a pressure assembly with a pressure relief valve to prevent the wrench from over-torquing.

It is another object of the present invention to provide a wrench having an internal hydraulic torque augmenting means which is actuated upon circular motion conducive to that used with a ratchet to provide torque output.

It is another object of the present invention to provide a wrench having a self-contained hydraulic torquing assembly which permits the user to operate the wrench independent of external systems.

It is another object of the present invention to provide a wrench having a dual-pawl assembly where the pawls are at different pitches with respect to a ratchet for the wrench so that at least one tooth of one of the pawls is engaged with the ratchet at all times.

It is another object of the present invention to provide a reaction arm removably mountable to a drive input for the wrench and adjustable for positioning the wrench for a torque operation. It is another object of the present invention to provide a reaction arm rotatable with respect to the wrench for use with a slugging wrench for a torque operation.

It is another object of the present invention to have a reaction arm which is height adjustable with respect to an exterior surface of the wrench to provide an impact zone at varying distances from the exterior surface.

It is another object of the present invention to provide a wrench having a cylinder disposed therein for support and operation of a piston-spring assembly for providing torque for the wrench.

It is another object of the present invention to provide a wrench which is adapted to provide a torque output either in a 2:1 ratio or, where hydraulics are used, in another ratio of force multiplied by distance.

It is another object of the present invention to provide a wrench for a torque operation which is adapted for use with an impact wrench and recoils during a torquing operation upon the recoil or slip of the impact wrench.

It is another object of the present invention to provide a wrench for a torque operation which has an internal hydraulic assembly for connection with a hydraulic contact wrench and constructed to recoil (or slip) in conjunction with the slip of the contact wrench.

It is another object of the present invention to provide a wrench for torquing operations which when operated hydraulically bypasses the manual drive input to actuate the drive output for the wrench.

It is another object of the present invention to provide a dual-pawl assembly for coaction with a ratchet at the drive output for the wrench, each one of the pawls having teeth constructed and arranged for engagement with the ratchet teeth at a predetermined interval during the torquing operation.

It is another object of the present invention to provide guide means consisting of bar elements disposed along a top and bottom of the housing for the wrench to provide structural support for the housing and movement of elements at an interior of the housing.

It is another object of the present invention to provide a wrench having a torque augmenting means which includes drag means for the ratchet of the wrench to restrict movement of the ratchet during initial stages of a torque operation.

BRIEF DESCRIPTION OF THE DRAWINGS

For a more complete understanding of the present invention, reference may be had to the following detailed description of the preferred embodiments taken in conjunction with the accompanying drawings, of which.

DETAILED DESCRIPTION OF THE PREFERRED EMBODIMENTS

Figure 1:
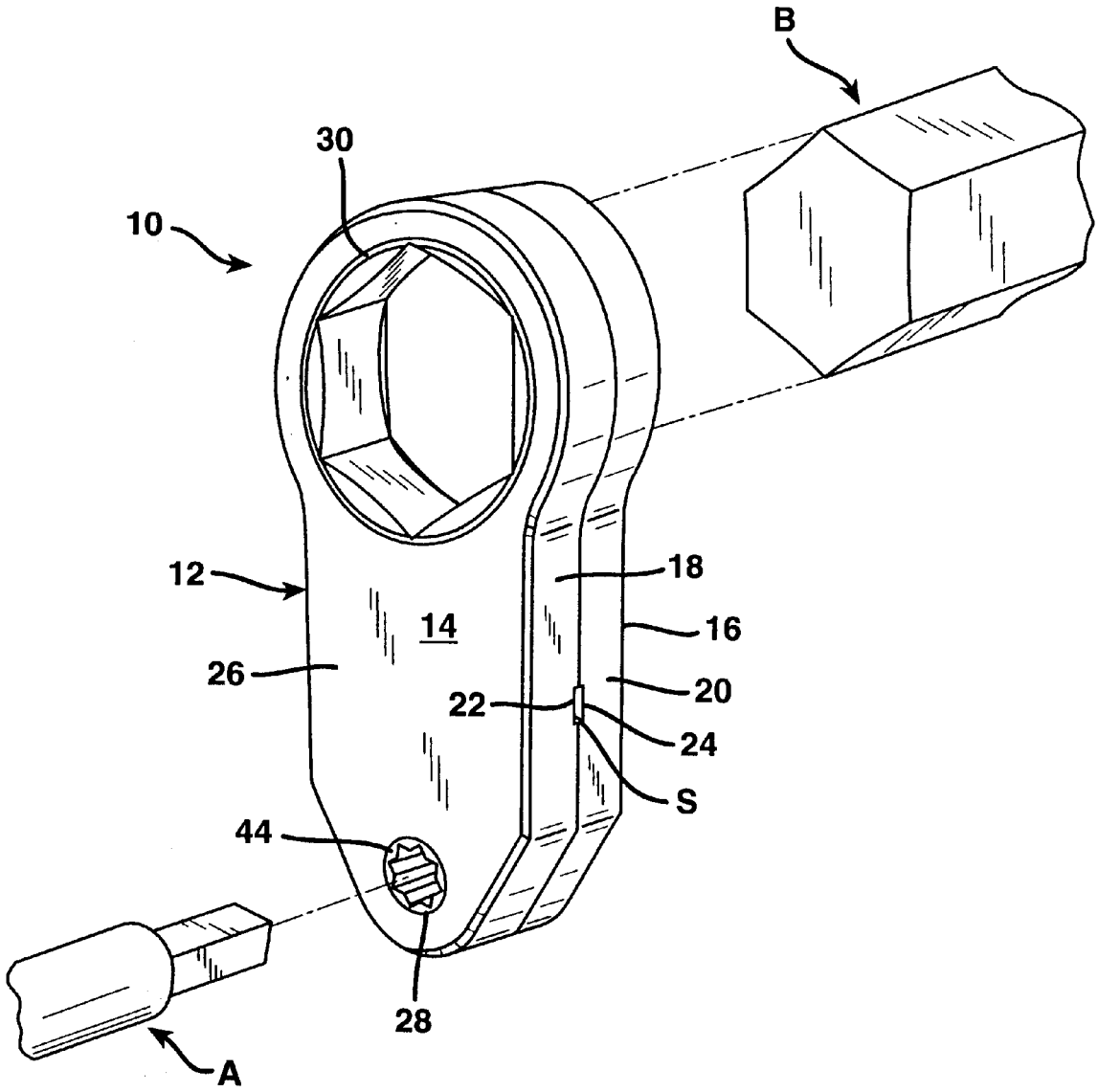
FIG. 1 is a perspective view showing a hand wrench with torque augmenting means according to the present invention.
Figure 2:
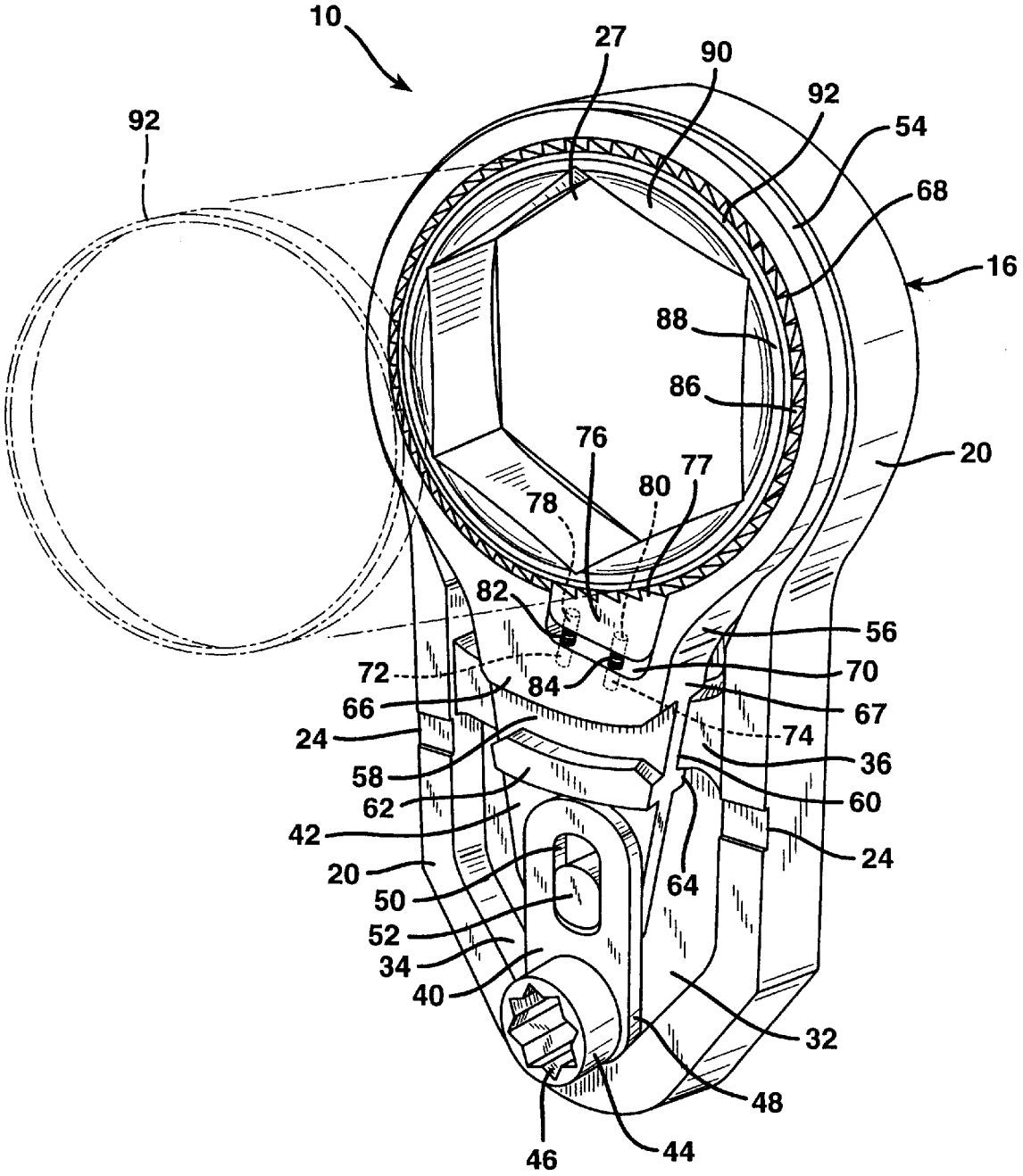
FIG. 2 is a top perspective view showing internal elements of the hand wrench.

Referring to FIGS. 1 and 2, a hand wrench having torque augmenting means of the present invention is shown generally at 10. The augmenter 10 is constructed to receive an external drive input A and transmit or augment the torque from the input A to an output B, such as a hex-sided stud or bolt.

The augmenter 10 consists of a housing 12 which is constructed from a pair of halves 14,16. The halves 14,16 can be held together by conventional mechanical fasteners such as screws, or with a friction fit. Each one of the halves 14,16 is provided with a continuous side wall 18,20 in which a corresponding detent or cutout 22,24 is formed. When the halves 14,16 are brought together to form the housing 12, they also provide a handle for the wrench, and the cutouts 22,24 formed in the respective side walls 18,20 are aligned in registration with each other to provide a space S at which force can be exerted to part the halves 14,16.

The half 14 has an exterior surface 26 upon which printed indicia can be displayed. The indicia can be instructions for operating the tool, logos, safety notices, etc. The half 16 has an exterior surface also for printed indicia which is not shown due to the perspective of the drawing Figures.

The half 14 is constructed with a small aperture 28 at one end thereof, the aperture 28 extending from the surface 26 completely through the half 14. An opposite end of the half 14 is formed with a larger aperture 30 which similarly extends from the surface 26 completely through the half 14.

Figure 3:
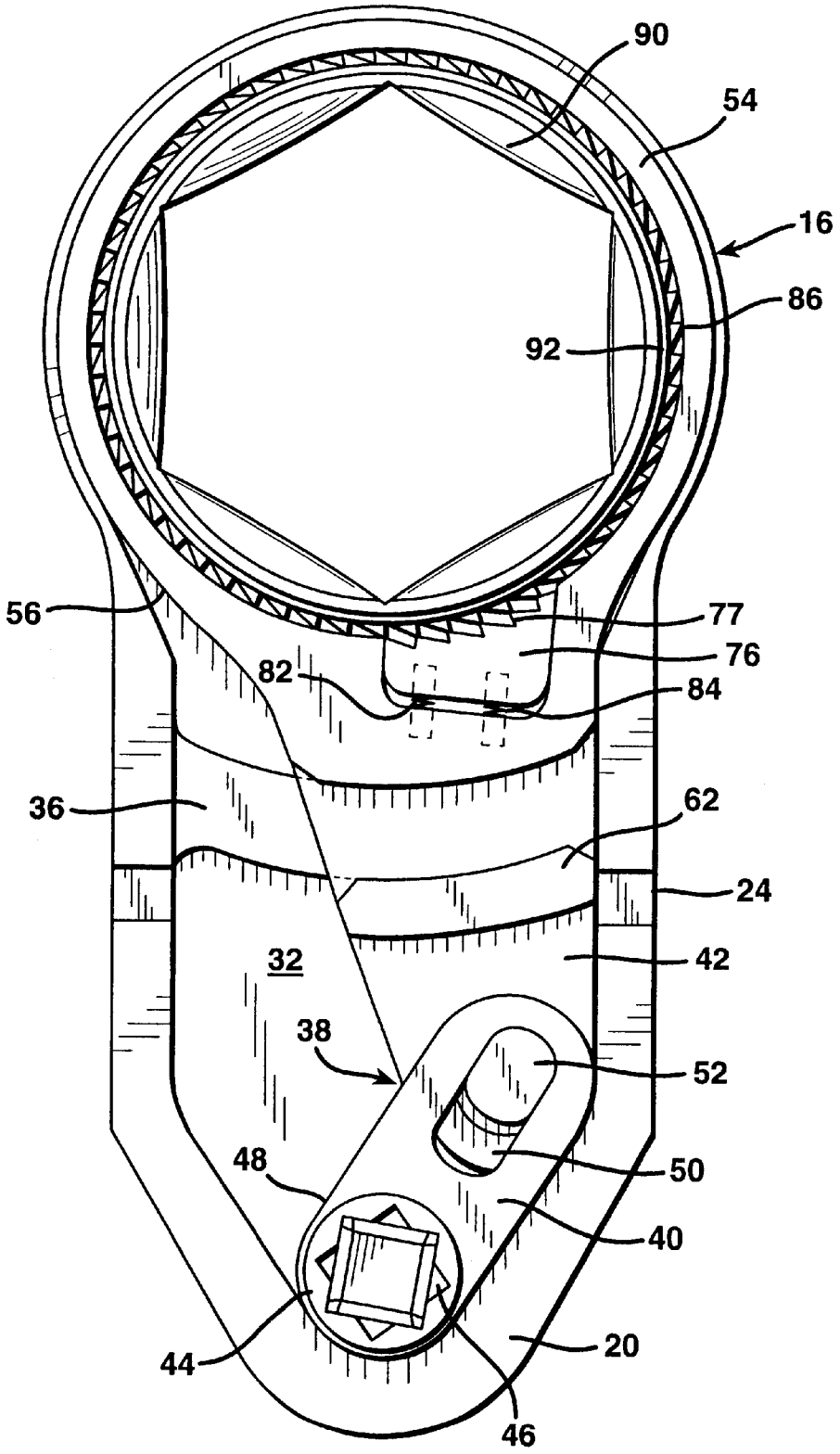
FIG. 3 is a top plan view showing the hand wrench at rest for a torque operation.

Referring also to FIGS. 2 and 3, additional elements of the augmenter 10 are also disclosed.

The half 16 includes an interior floor 32 from which the continuous side wall 20 extends upward therefrom. The side wall 20 is provided with an inner surface 34. An arcuate guide bar 36 extends upward from the floor 32. The guide bar 36 extends across the floor 32 such that each one of the opposed ends of the guide bar 36 is connected to a corresponding portion of the inner surface 34 of the continuous side wall 20 at opposite sides of the floor 32.

In FIG. 3, the augmenter 10 of the present invention is shown at rest ready to commence a torque operation. The elements of the augmenter 10 which enable the transmission and augmenting of torque are as follows.

A linkage assembly shown generally at 38 is constructed and arranged for operation when the halves 14,16 are joined together. The linkage assembly 38 includes a drive finger 40 and a driven arm 42.

The drive finger 40 has a first end from which an upstanding cylindrical portion 44 extends. The cylindrical portion 44 extends through both halves 14,16 when joined together. The drive finger 40 rotates about the cylindrical portion 44. The cylindrical portion 44 is provided with a hex or other multi-sided aperture 46 (FIG. 2) extending completely therethrough. The aperture 46 is adapted to act as an engaging receptacle for a multi-sided male drive member A. The aperture 46 is constructed and arranged in the drive finger 40 to be in registration with the aperture 28 of the half 14. The half 16 is similarly provided with an aperture which is in registration with the aperture 28 of the half 14, such that when the halves 14,16 are joined to each other with the linkage assembly 38 disposed therebetween, the multi-sided aperture 46 of the drive plate 40 is accessible at the smaller aperture 28 of the half 14 or at the corresponding aperture (not shown) in the other half 16. This permits the user to extend the drive input A completely through the housing 12, or to enable access to the engaging receptacle from either side of the housing. Therefore, the receptacle will always be accessible even if necessary to turn the augmenter 10 over for an operation.

The drive finger 40 is constructed with a side wall generally shown at 48 which substantially conforms to the tapered shape of the inner surface 34 of the side wall 20 of the half 16. As shown in FIG. 3, an arcuate portion of the side wall 48 is constructed to rest against and be received by the complimentary tapered inner surface 34. This permits the drive finger 40 to pivot in position and rest against the side wall 20. However, as will be discussed hereinafter, the drive finger 40 does not exert a pressure load against the side wall 20 which would be sufficient to weaken the side wall 20.

The opposite, free end of the drive finger 40 is formed with an oblong-shaped aperture 50 extending completely therethrough. A longitudinal axis of the oblong-shaped aperture 50 bisects a central axis of the multi-sided aperture 46.

The driven arm 42 includes at one end a pin 52 extending therefrom. The pin 52 is constructed and arranged to be in registration with and received by the oblong-shaped aperture 50 of the drive finger 40. The pin 52 is similarly oblong-shaped and is of a height that preferably is at least equal to the depth of the oblong-shaped aperture 50, and does not exceed the greatest height of the driven arm 42. The pin 52 is rotatably mounted to the driven arm 42. Alternatively, the pin 52 may be circularly shaped and fixed to the driven arm 42.

The driven arm 42 widens as it extends to assume a circular shape. As also shown in the perspective view of FIG. 2, a larger, circular shaped portion of the driven arm 42 is shown generally at 54.

The driven arm 42 is provided with side walls 56 and 57 which are shaped to engage along their entire length or to engage substantially along their entire length the inner surface of the continuous wall 20 of the housing when the driven arm is at the end of its travel. This tends to distribute the forces produced by the side wall of the driven arm 42 along the entire housing, minimizing the stress at any one point.

The shape of the side wall 56 permits the driven arm 42 to pivot freely within the half 16 when the driven arm 42 coacts with the drive finger 40.

An arcuate boss 62 or ridge extends upward from the driven arm 42 to coact with the drive finger 40. The height of the boss 62 substantially corresponds to the thickness of the drive finger 40 for a purpose to be described with reference to FIGS. 4 and 5.

Grooves 58 and 60 respectively are machined in the driven arm leaving ridges 62 and 66, and 64 and 67 respectively. The grooves 58 and 60 are adapted to mate with a pair of arcuate ridges. The arcuate ridge on the floor of the top plate is not shown. The arcuate ridge on the bottom half being designated as 36. The coaction of the grooves 60 on the driven arm with the arcuate ridge 36 on the back half of the housing provides a guide for movement of the driven arm and also provides for structural support of the driven arm as it is moved by the drive finger. The top of the ridges 62 and 66 on the front side and 64 and 67 on the rear extend to the inner surface of the housing when the halves 14,16 are assembled.

As shown more particularly in FIG. 2, the arcuate guide bar 36 is sized and shaped to be received in the groove 60, while another arcuate guide bar (not shown due to the perspective view of the Figures) of half 14 is received in the groove 58. This construction permits the driven arm 42 to ride along the arcuate guide bar 36 and the prescribed angle of arc of the guide bar 36. The driven arm 42 widens generally at 66 into a circular portion having an aperture 68 extending completely therethrough and in registration with the large aperture 30 of the plate 14 and the aperture 27 of the plate 16. The circular portion 66 of the driven arm 42 is formed with a recess 70 in communication with the aperture 68. A pair of bores 72,74 are formed in the circular portion 66 of the driven arm 42 and open into the recess 70.

A pawl 76 is disposed in the recess 70. The pawl 76 is formed with a pair of bores 78,80, each of which is in registration with a corresponding one of the bores 72,74 of the driven arm 42. Springs 82,84 are disposed in the recess 70, each one having its opposed ends terminating in a corresponding one of the bores 72,78 and 74,80, respectively. The springs 82,84 resiliently bias the pawl 76 to float in the recess 70 so that inclined teeth 77 of the pawl 76 are urged to engage corresponding inclined teeth 86 of a ratchet 88 disposed in the large aperture 30.

The ratchet 88 fits in a stepped portion of the aperture 68. The aperture 68 has a larger diameter and a smaller diameter. The larger diameter will accommodate the teeth of the rachet and the small diameter will support the teeth and enclose the entire ratchet mechanism.

The ratchet 88 is circular in shape and is received in the large circular end 54 of the driven plate 42 to surround a hex socket 90. The ratchet 88 is connected to and preferably an integral part of the hex socket 90.

A circular shaped wear collar 92 is constructed and arranged to extend around the hex socket 90 above the ratchet teeth 86. The wear collar 92 is made from bronze or other soft alloy to reduce friction during a torque operation when the halves 14,16 are joined to form the housing 12.

The starting position of the torquing operation is shown for example in FIGS. 1 and 3. First, the housing 12 of the augmenter 10 is grasped and the large hex will be engaged with the item to be tightened such as the output shaft B. The handle of the wrench 12 is then manually turned much as a standard socket head wrench until the output shaft is tight and further movement of the handle manually is no longer possible. If augmented torque is required, then an augmenting drive shaft A is entered into the augmenting receptacle aperture 46. The input shaft A can then be rotated. This can either be a long lever, or it can be a power type of unit. However, even a twelve inch (12") additional lever rotating the augmenting receptacle will be sufficient to produce substantial augmenting torque, since the lever can be substantially longer than the length of the handle. Additionally, since the handle must be located in a fixed position in a specific location with respect to the output shaft to be tightened, there may not be sufficient room to obtain proper purchase for rotating the handle of the augmenter, whereas an auxiliary lever or rotating bar can extend to an area of greater freedom when using the augmenting feature.

Figure 4:
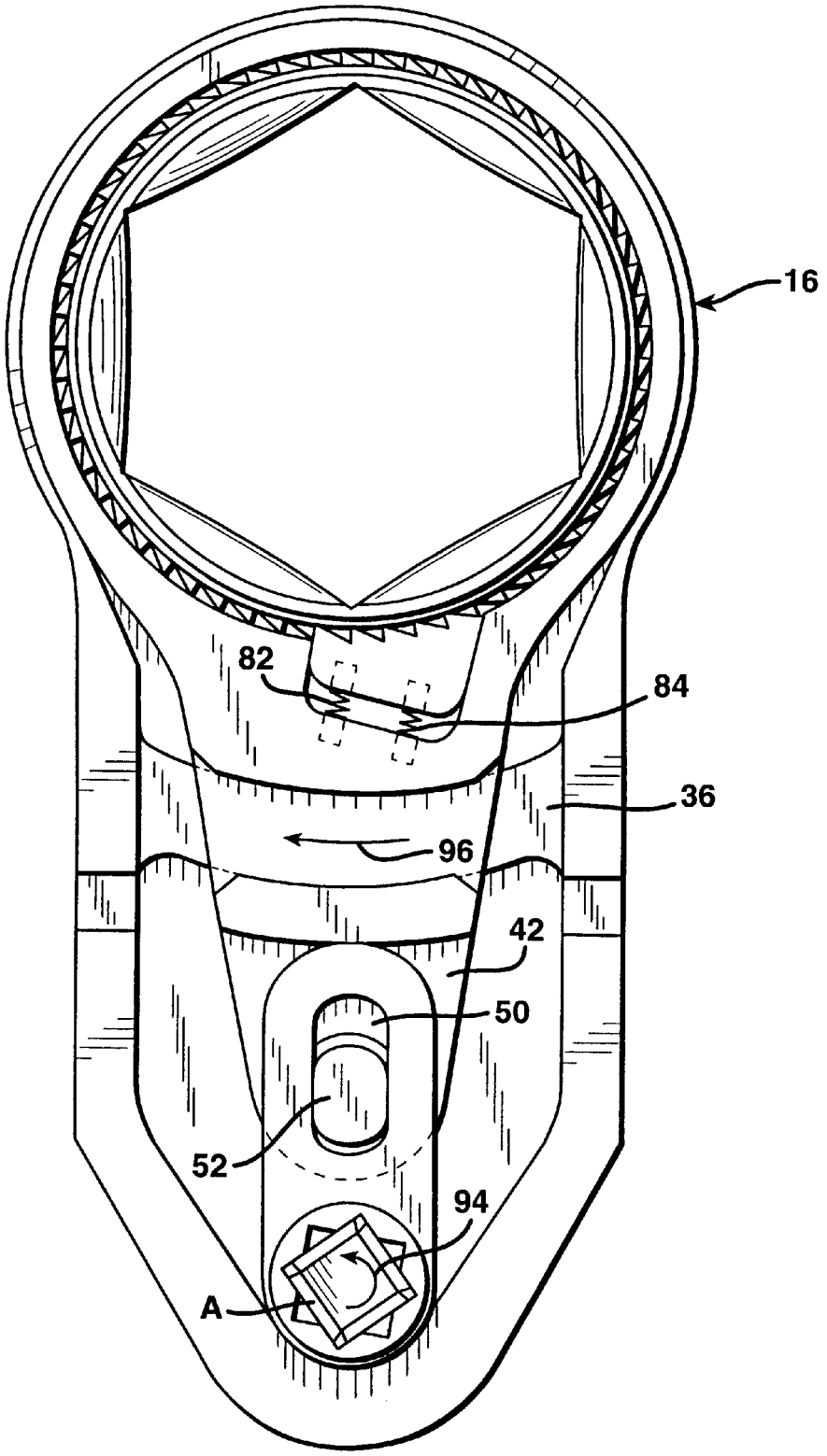
FIG. 4 is a top plan view of elements shown in the view of FIG. 3 coacting for a torque conversion stroke.

The input A is turned as indicated by the arrow 94 shown in FIG. 4. The rotation is in, for example, a counter clockwise direction. Accordingly, the drive finger 40 is also urged to pivot in a counter clockwise direction. The driven arm 42 is urged to move in a direction of arrow 96, while the pin 52 moves along the oblong-shaped aperture 50 of the drive finger 40.

The arcuate guide bar 36 extending upward from the bottom 32 of the plate 16 provides a stress point for the drive finger 40 and the driven arm 42. That is, as the finger and arm 40,42 respectively, are pivoted, there is a tendency for the finger 40 and arm 42 to be forced away from each other which would, but for presence of the guide bar 36, cause a detrimental amount of force to be incurred by the continuous side wall 20 of the plate 16. The guide bar 36 restricts the "parting" of the linkage assembly 38 and channels the stress and forces which occur during the torque operation to a more central location of the plate 16. Such forces are disbursed so that the structural integrity of the halves 14,16, and therefore the housing 12, is not compromised.

As the linkage assembly 38 is pivoted, the inclined teeth 77 of the pawl 76 engage the corresponding inclined teeth 86 of the ratchet 88. This motion forces the hex socket 90 to pivot as indicated by arrow 98 in FIG. 5 to tighten down the bolt B.

Figure 5:
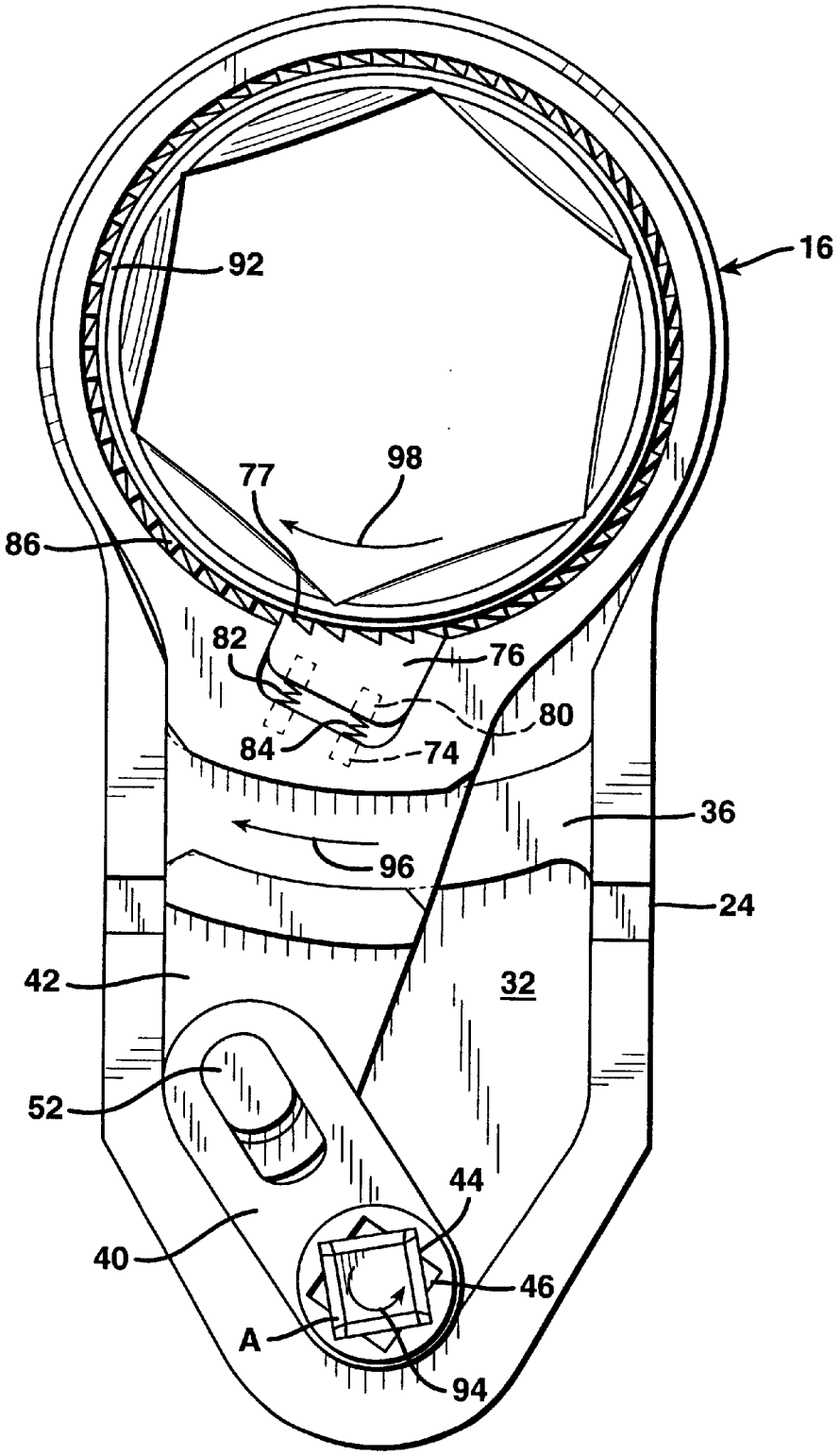
FIG. 5 is a top plan view of the hand wrench of FIG. 4 completing the stroke.

The springs 82,84 as shown in FIGS. 4–5, bias the pawl 76 toward the ratchet 88 for engagement of the teeth 77,86. The motion of the linkage assembly 38 is therefore imported to the hex socket 90 to allow effective motion only in the direction as indicated by the arrow 98.

When the "throw" of the linkage assembly 38 is complete, as shown in FIG. 5, the input A is moved in the opposite direction, i.e. clockwise, to return the linkage assembly 38 for another torque operation. This movement permits the inclined teeth 77 of the pawl 76 to ride over the inclined teeth 86 of the ratchet so that the mechanism can be reset as in FIG. 3 for another torque cycle.

Figure 6:
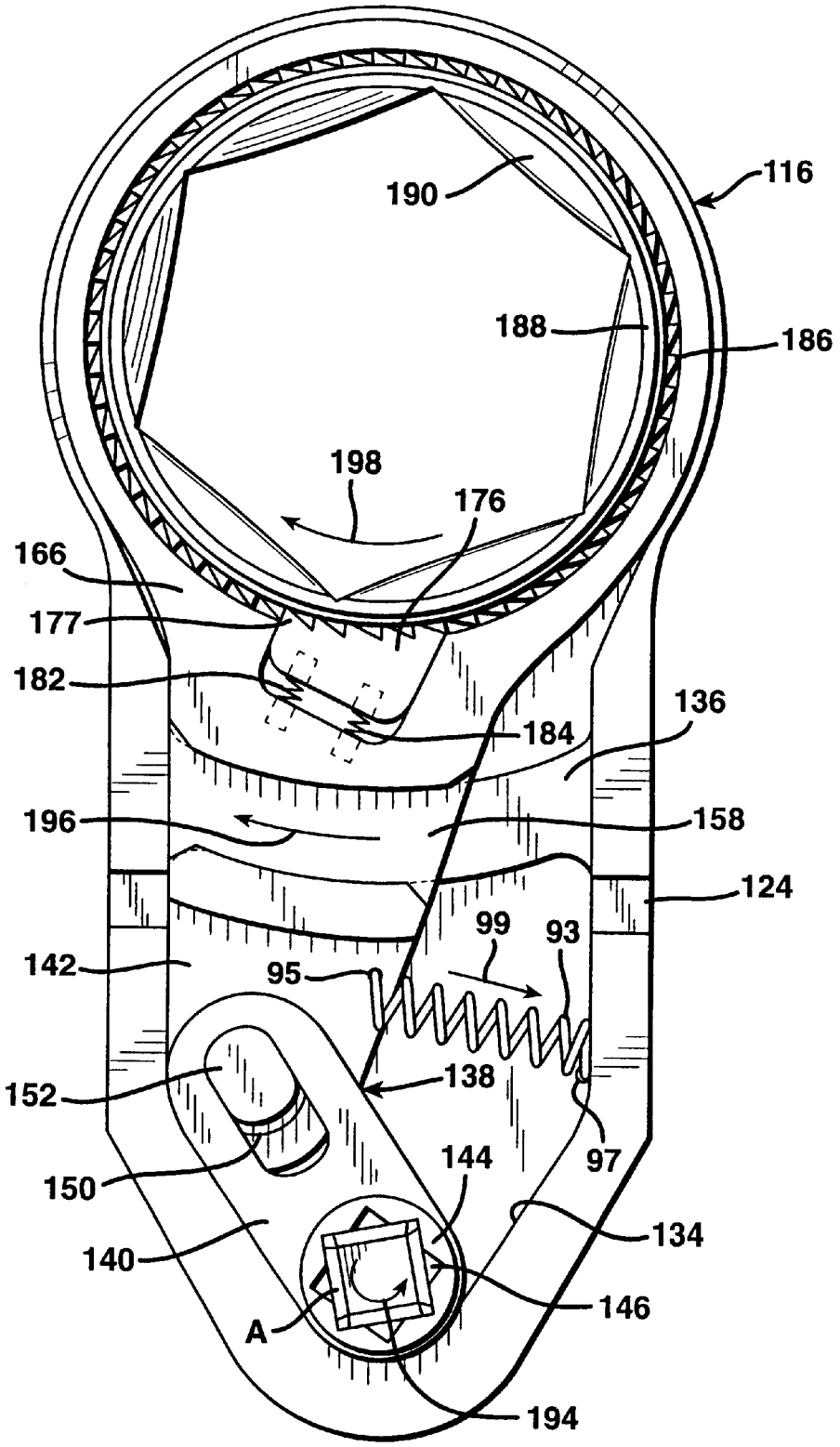
FIG. 6 is a top plan view showing elements of another embodiment of the hand wrench according to the present invention.

Another embodiment of an augmenter 110 constructed in accordance with the present invention is illustrated at FIG. 6. Elements illustrated in FIG. 6 which correspond to elements described above with respect to FIGS. 1–5 have been designated by corresponding reference numerals increased by 100. The embodiment of FIG. 6 is designed for use in a manner similar to that shown with respect to the embodiment of FIGS. 1–5, unless otherwise stated.

Referring now to FIG. 6, an additional biasing element 93 is shown. The biasing element 93 can be an extension spring, as shown in FIG. 6, or a torsion spring. In the example shown, the extension spring 93 has one end 95 connected to the driven arm 142, and an opposite end 97 connected to the continuous side wall 120 of the plate 116. The spring 93 inherently biases the linkage assembly 138 in a direction of arrow 99 to facilitate the return of the linkage assembly 138 to the starting position after the "throw" of the linkage assembly 138 is complete.

The construction and coaction of the drive finger 140 and the driven arm 142 of the linkage assembly 138 is such that a pair of springs 93 can be employed. That is, in addition to the spring 93, another spring (not shown), or a plurality of springs can be attached to the driven arm 142 at an opposite side to which the spring 93 is attached, and then to a corresponding portion of the side wall 120 to facilitate movement of the linkage assembly 138 in either direction.

The augmenter 110 is not limited to having only an extension spring such as that shown in FIG. 6. The device can be constructed with a combination of extension springs and torsion springs to operate as the biasing element 93.

It is preferred to mount the biasing element 93 as shown, as this position is proximate to the region of pivotal coaction between the drive finger 140 and the driven arm 142, thereby most effectively using the biasing force of the spring 93.

Figure 7:
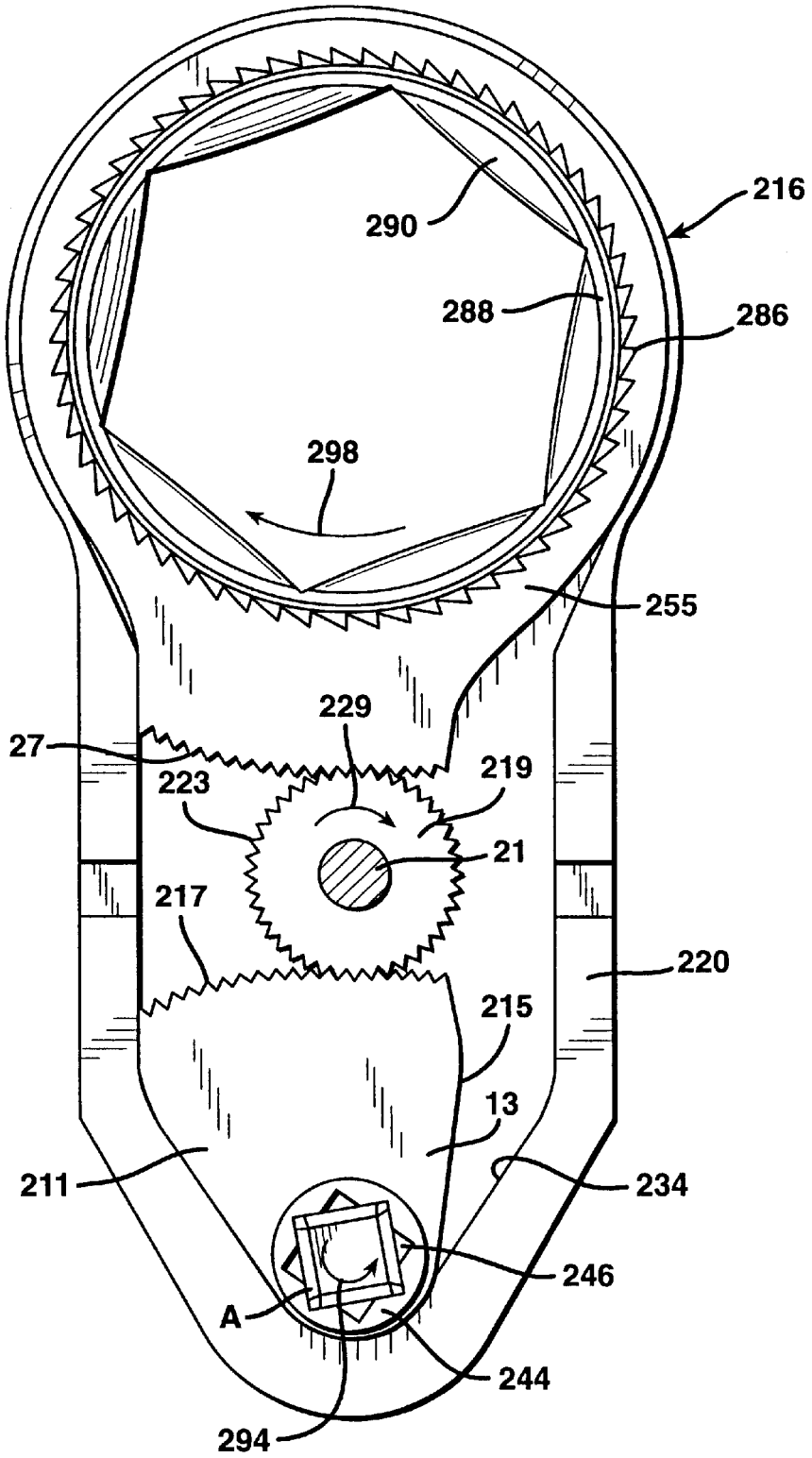
FIG. 7 is a top plan view showing elements of still another embodiment of the hand wrench according to the present invention.

Another embodiment of an augmenter 210 constructed in accordance with the present invention is illustrated at FIG. 7. Elements illustrated in FIG 7. which correspond to elements described above with respect FIGS. 1–5 have been designated by corresponding reference numerals increased by 200. The embodiment of FIG. 7 is designed for use in a manner similar to that shown with respect to the embodiment of FIGS. 1–5, unless otherwise stated.

In FIG. 7, a drive finger 211 has a first end from which a cylindrical portion 244 extends. The cylindrical portion 244 is provided with a hex or other multi-sided aperture extending completely therethrough. The half 216 is similarly provided with an aperture which is in registration with the aperture 246 of the half 214, such that when the halves 214, 216 are mated, the multi-sided aperture 246 of the drive finger 211 is accessible from an exterior of the half 214. This permits the user to extend the drive input A completely through the housing regardless of the length of the input A. The drive finger 211 is constructed with a side wall generally shown at 13 which substantially conforms to the shape of the upstanding side wall 220 of the half 216.

As shown in FIG. 7, a side wall 215 of the drive finger 211 is constructed to rest against the complimentary shaped side wall 220 extending from the half 216. This permits the drive finger 211 to pivot in position and rest against an inner surface 234 of the side wall 220.

An opposite end of the drive finger 211 is formed with a rack of teeth shown generally at 217. The rack 217 extends completely along this end of the drive finger 211 and is of a particular thickness and pitch for coaction with other elements of this embodiment as discussed below.

A transfer gear 219 is disposed for pivotal movement between the halves 214, 216. The transfer gear 219 is mounted to the half 216 by a pin 21. A plurality of teeth 223 extend along a peripheral edge of the gear 219, which teeth 223 are constructed and arranged for releasable mating engagement and contact between corresponding teeth 217 on the drive finger 211. During a torque operation, at least three or four, and preferably five of the teeth 217,223 on the drive finger 211 and the transfer gear 219, respectively, are in contact to provide strength and stability during the torque operation.

The driven arm 255 in FIG. 7 is provided with a rack of teeth 27 extending along a peripheral edge of a portion thereof. The pitch of the teeth on the rack 27 of the driven arm 255 is equal to the pitch on the teeth 217 on the drive fingers 211. The rack of teeth 27 is of a thickness and pitch to facilitate releasable mating contact with the teeth 223 of the transfer gear 219. At least three or four, and preferably five teeth of the transfer gear 219 and driven arm 225 mesh during a torque operation to facilitate strength and stability of the device during the operation.

Springs (not shown) can also be used with the embodiment of FIG. 7 to bias the drive finger 211 and driven arm 225 to their selective positions.

The embodiment of FIG. 7 operates as follows.

The drive input A is inserted into the aperture 246 and turned in the direction of arrow 294. The drive finger 211 is moved in a counter-clockwise direction with the teeth 217 thereof in engagement with the teeth 223 of the transfer gear 219. The transfer gear 219 in turn rotates in a clockwise direction as shown by the arrow 229. This motion of the transfer gear 219 causes the driven arm 255 to move in a clockwise direction as indicated by the arrow 298 to impart a rotational movement to the teeth 286 of the ratchet 288. The hex socket 290 is also moved in a clockwise direction to turn the bolt or stud being tensioned. When the hex socket 290 has been turned down on the bolt or stud through a complete "throw" of the turning operation, the device is returned by the user in an opposite direction for the driven arm 255 to ride over the teeth 286 to prepare for a subsequent torquing operation during which the teeth 286 of the ratchet 288 are engaged to subsequently cause the hex socket 290 to tighten down the bolt.

The height of drive finger 211 and driven arm 255, in combination with locking means (not shown) for the housing function as a guide for 211,225.

The construction of the teeth used for the drive plate 211, transfer gear 219 and driven arm 255, are selected for gear backlash to be within tolerable limits so that slippage is reduced as much as possible upon reversal of the gear rotation.

As shown in FIGS. 1–5, the wrench with augmenting device can be used as a simple hand wrench tool to either tighten or loosen nuts to another fastener. The socket of the wrench is fitted over the item to be loosened or tightened in the same manner that a ratchet type socket wrench would be fitted over any standard item to be wrenched. Note that nesting sockets (not shown but well known in the art) could be used to modify the size of the engaging socket in order to give the tool a wider range of operative use. The tool also has a relatively narrow rim between the socket and the outer edge of the tool surrounding the socket. This enables the tool to be placed into relatively narrow areas which is often the case with bolting circles and other areas which provide limited access for the worker. The tool is then operated as a standard ratchet socket wrench. The handle is rotated about the socket to loosen or tighten the item that is to be wrenched. In an instance where a high torque is necessary; either to "break" or dislodge a nut or other fastener which tends to become frozen in place, or to "snug up" the item to be tightened when it is no longer possible to easily move the handle of the wrench, then the augmenting feature of the wrench is employed. A mating drive fits into the drive socket or receptacle in the bottom of the handle. This drive implement can be a relatively long bar or it can be connected to the output drive of a mechanical or pneumatic device. The auxiliary drive member is then actuated to rotate the driven socket in the handle, which actuates the linkage in the handle of the wrench to rotate the socket through a limited angle as discussed. This limited angle will be sufficient to tighten or loosen the item that is being acted upon by the wrench. If it turns out that the linkage in the handle of the wrench has "stopped out" or run its full travel without reaching the desired level of torque being applied by the actuating socket of the wrench then the auxiliary torque apparatus can be reversed. The rachet feature of the wrench, will allow the linkage within the handle to return to the initial position. The auxiliary torque apparatus does not have to be removed from the drive socket at the bottom of the handle, but merely rotated in a direction opposite to the force applying direction because the ratchet feature will allow the linkage within the handle to return to its initial position.

The wrench of course can be used to tighten or loosen, merely by turning the wrench over, and using one face for turning in a clockwise direction and the other face for turning in a counter clock-wise direction. As shown in FIGS. 2–5, the front and back halves of the housing have ridges which coact with and guide the grooves in the driven arm of the linkage over a relatively wide area. Additionally, the sides of the driven arm are shaped to conform with or abut the interior side walls of the linkage along a long length of the driven arm. This will tend to dissipate the force that will be applied to the housing by the linkage when the linkage is "stopped out" at the end of its travel. Similarly, the pin arrangement and slotted drive finger allow for relatively wide contact surfaces to minimize wear. The ridges or raised portions on the driven arm which surround the rachet at the lower end which form the groove for the ridges from the housing act as a stiffening member when the pieces are assembled to provide strength for the handle making the tool relatively rugged but still operable.

The ratchet and socket arrangement is relatively simple and reliable, and the wear features of the construction insure not only that the life of the tool will be relatively long, but its operation will be relatively easy.

Shown in FIG. 6 are a variety of springs which can also be used to bias the driven arm of the apparatus. The springs can be compression springs or torsion springs.

As shown in FIG. 7, the apparatus can also be built in a variety of ways such as by use of an idler gear between two gear racks, which replaces the linkage.

Figure 8:
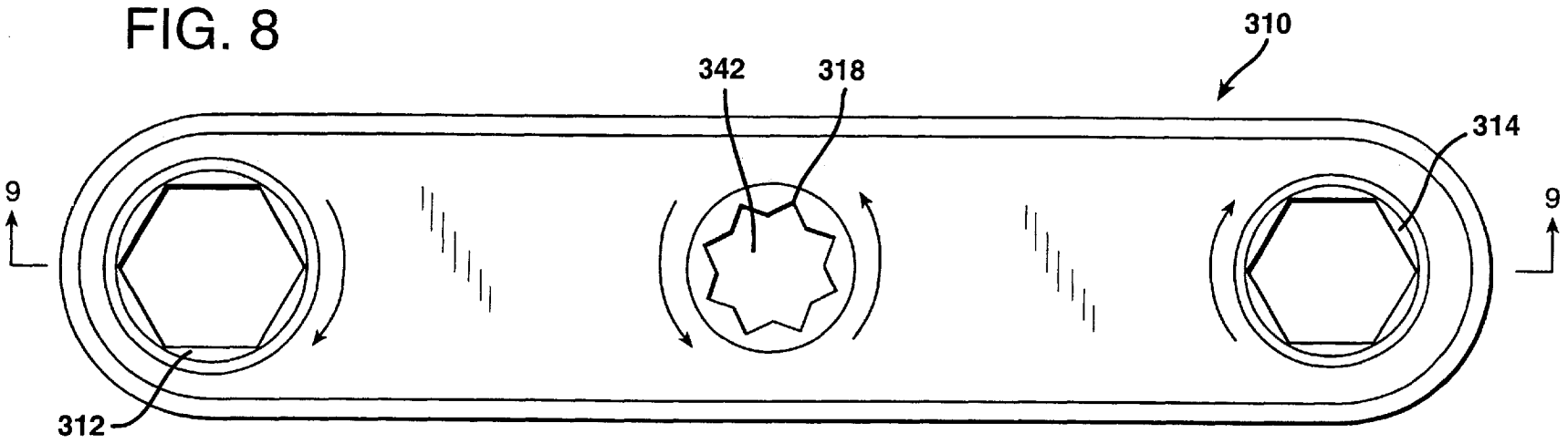
FIG. 8 is a top view of another embodiment of the invention having driven apertures on each end of the device and being relatively symmetrical in nature, with a drive aperture centrally located.
Figure 9:
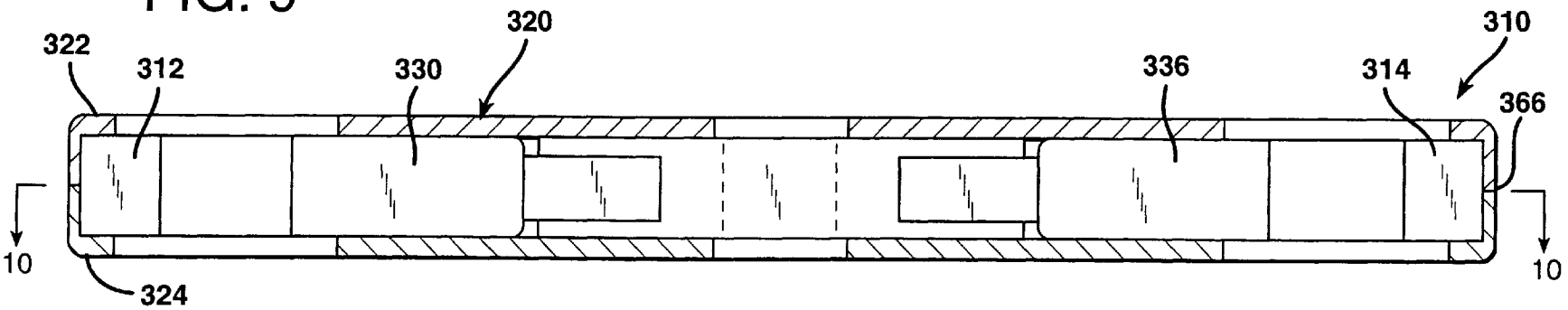
FIG. 9 is a side view taken along line 9—9 of FIG. 8.
Figure 10:
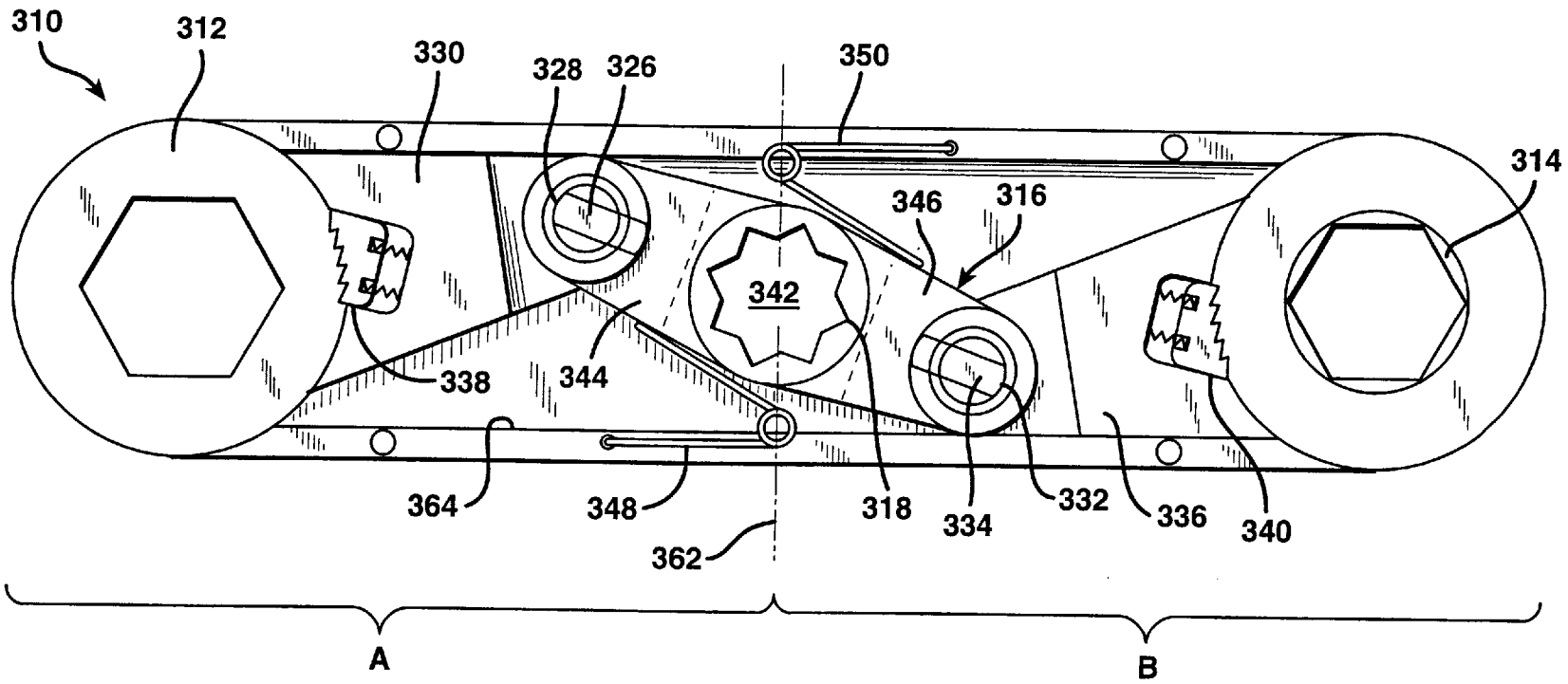
FIG. 10 is a view taken along line 10—10 of FIG. 9.

Referring to FIGS. 8–10, there is shown another embodiment of the invention at 310 having a symmetrical arrangement in which a pair of drive sockets 312,314 are provided, each driven from a link 316 connected to the driven middle socket 318. The drive sockets 312,314 and link 316, as well as other elements of this embodiment discussed below, are disposed in a housing 320 for the augmenter 310 consisting of releasably engagable halves 322,324. The same form of linkage shown in FIGS. 2–6 is present in the augmenter 310, with the oval pin 326 rising in slot 328 in the driven arm 330 of region A, and oval pin 332 rising in slot 334 from the driven arm 336 in region B. A similarly constructed ratchet and pawl arrangement 338,340 is used with respect to each of the drive sockets 312,314 at each end of the wrench. Driving the driven aperture 342 of the socket 318 will cause rotation of the link 316 with the opposing driven arms 330,336. The drive fingers 344,346 rotate the driven arms 330,336 to rotate the adjacent ratchet assemblies 338,340 until the driven arms 330,336 abut a respective opposed side of the housing 320 along the length of the arms 330,336.

The driven or middle link 316 has torsion springs 348,350 on either side attached to the adjacent wall of the housing. The springs 348,350 each slide as the middle link is rotated, and tend to urge the middle link 316 into the initial position as shown in the drawing.

Figure 11:
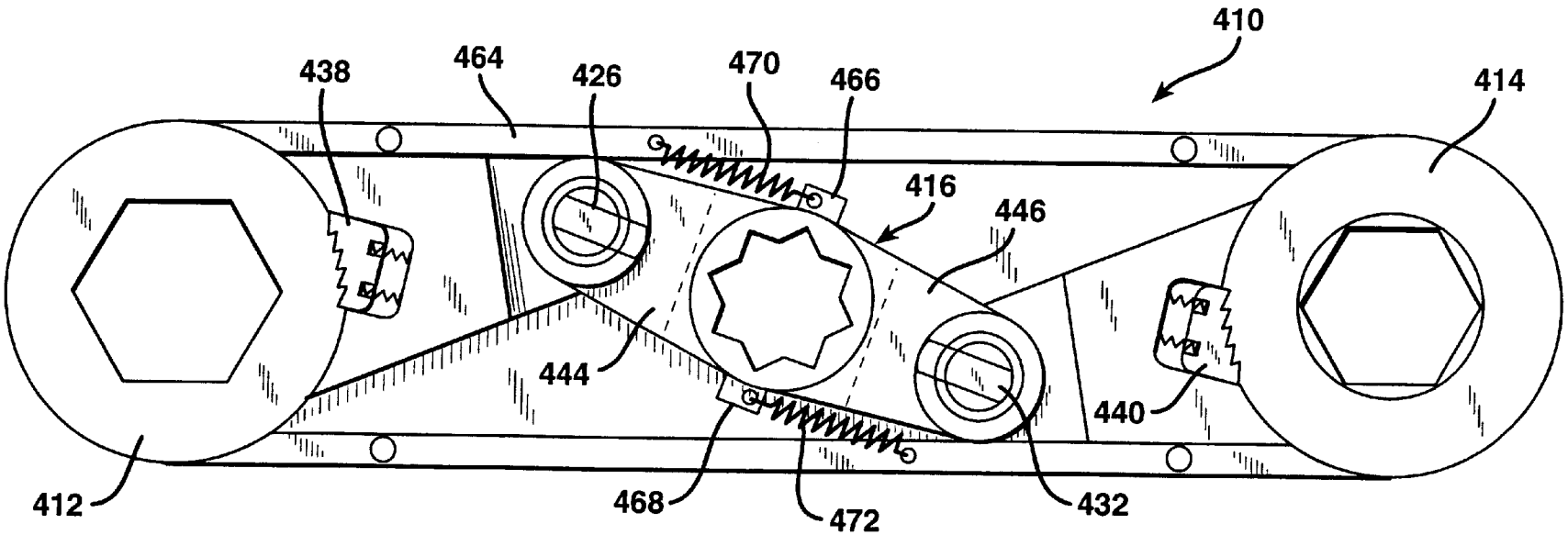
FIG. 11 is another embodiment of the invention similar to the view shown in FIG. 10.
Figure 13:
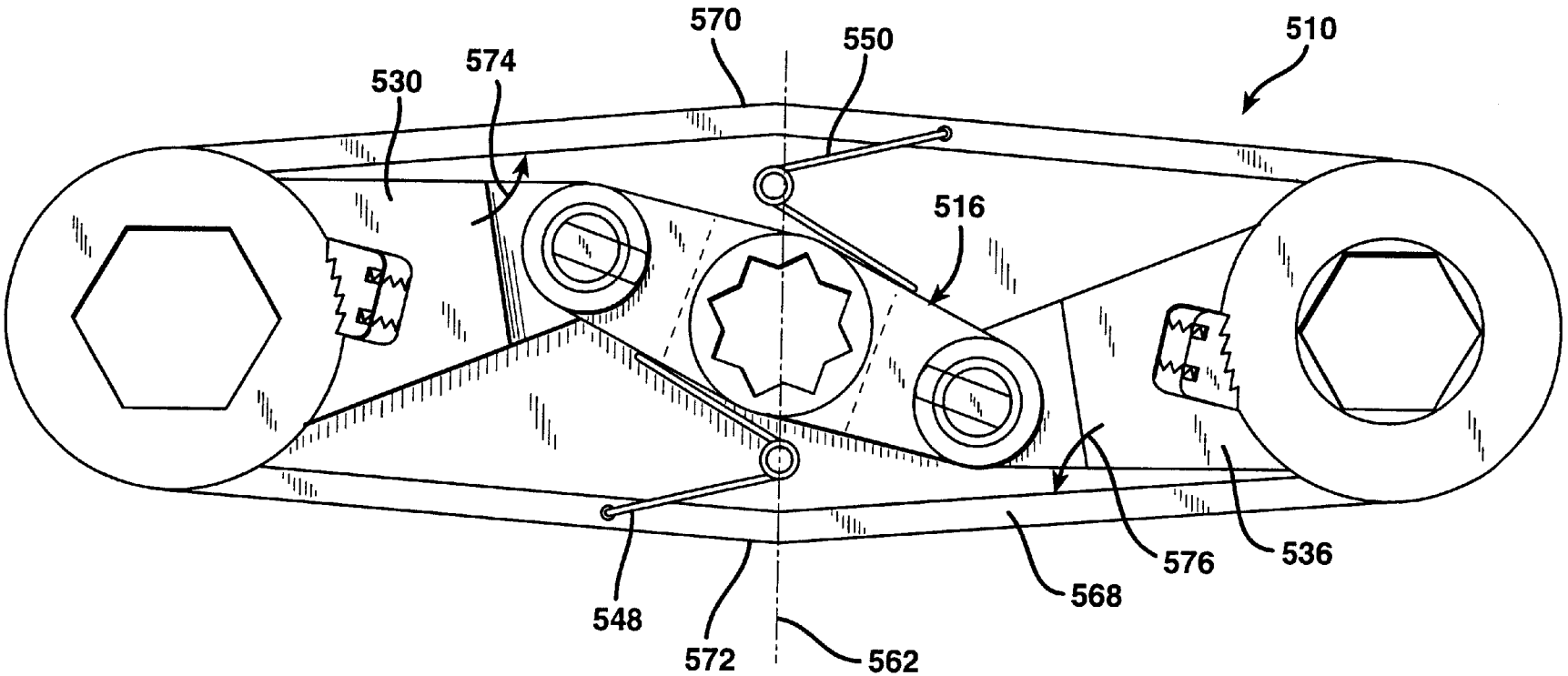
FIG. 13 is a view of another embodiment of the present invention similar to the view shown in FIG. 10.

The various guides, slots and grooves that are shown in FIGS. 1–7 on the front and back walls of the housing, and on the driven arms of the apparatus can also be included in the structure of the embodiment shown in FIGS. 8–10, and the embodiment shown in FIGS. 11 and 13.

While the augmenter 310 is shown having parallel sides and is relatively symmetrical, these dimensions will vary depending upon the size of the drive sockets 312,314 at either end of the device and the intended use of the tool.

If, for example, it is desired to have a longer throw for each cycle of the augmenter 310, then the central portion of the tool between the drive sockets 312,314 can be widened as shown and discussed with respect to FIG. 13. This will provide a longer distance for the driven arms 330,336 to travel and therefore, increase the angle for each cycle.

Additionally, the size of the drive sockets can vary from less than an inch to more than 9 inches to accommodate nuts which fasten to studs of 6" or more in length.

Figure 12:
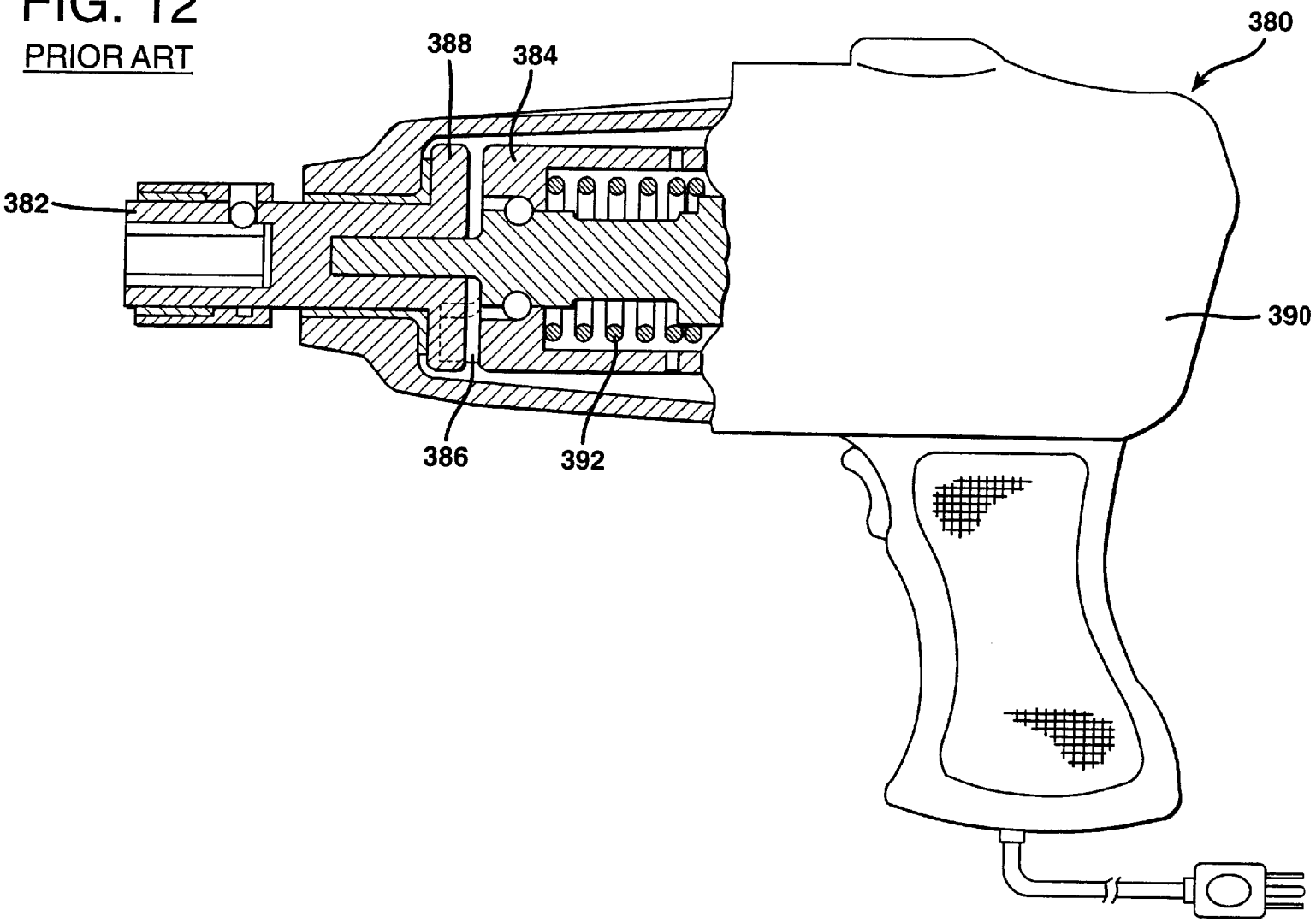
FIG. 12 PRIOR ART
FIG. 12 is a cross-sectional view of an impact wrench known in the art.

The system is well suited for use with external torquing devices, such as a commonly available impact wrench 380 shown in FIG. 12. This impact wrench 380 has a transmitting end 382 which is driven by a slide collar 384, that will oscillate back and forth, to engage and disengage the finger 386 extending from the collar to ride on camming surface 388 connected to the transmitting end 382. When the torque exerted by a motor 390 is sufficiently high to cause the torque level adjusting spring 392 to retract, the engaging finger 386 will ride up the cam surface 388 to a point such that the spring 392 is compressed sufficiently to enable the finger 386 to disengage from the camming surface 388 and allow the device to rotate internally without externally rotating the transmitting end of the device.

By inserting the transmitting end of the impact wrench into the driven socket 318 at the middle of the augmenter 310, the drive link 316 will rotate the drive fingers 344,346.

The housing halves 322,324 are joined together as shown in FIG. 9. A gasket 366 is interposed between the halves to seal a lubricant, such as grease for the elements, within the augmenter 310. The gasket can be formed by filling corresponding grooves in the mating surfaces of the housing with a substance that will cure to form a gasket.

There is a coaction between the internal spring of the impact wrench which causes the periodic application of torque, and the internal springs 348,350 connected to the link 316. The impact wrench produces an increase in torque and rotation until disengagement occurs between the drive finger and the camming surface. During movement of the impact wrench, the driven or middle link 316 of the augmenter 310 will move from the initial position as shown in FIG. 10 to a position at the opposite end of its travel against the other wall. When the spring of the impact wrench causes disengagement, the torque asserted is suddenly substantially reduced and the spring arrangement 348,350 of the augmenter will then cause the middle link 316 to rotate to the initial position shown in FIG. 10, bringing each one of the driven arms 330,336 up flush against a respective side of the inner wall 364 of the housing.

As the collar of the impact wrench 352 rotates in the direction of the arrows surrounding middle aperture 342, or in a counter-clockwise direction, the driven arm will rotate in the clockwise direction to rotate the driven socket 318 until the opposite side of the driven arm abuts the inner wall 364 of the housing.

To use the augmenter 310 to remove a fastener, the augmenter is turned over so that the angles are reversed and the direction of the impact wrench is also reversed.

As shown in FIGS. 9 and 10, the elements for the augmenter 310 are symmetrical about the central transverse axis 362. Regions A and B of the augmenter 310 at opposed sides of the axis 362 include elements which function in a symmetrical manner of operation. This provides for even torque augmentation during cycling and recycling, and relatively equal amounts of stress and wear upon the operable elements of the device.

FIG. 11 shows another embodiment of the augmenter invention shown generally at 410, in which a middle link 416 has two ears 466,468, which are used to connect compression springs 470,472, respectively, to the sidewall 464 of the housing. The compression springs 470,472 function in the same manner as the torsion springs 348,350 shown in FIG. 10, i.e. the function to position the middle link 416 to one extreme position to urge the driven arms 444,446 abutted against the wall 464.

FIG. 13 shows still another embodiment of the augmenter invention according to the present invention which is shown generally at 510. In this embodiment, a sidewall 568 of the augmenter 510 is bowed or widened at opposed sides shown generally at 570,572, with the apex of each widened portion occurring at approximately the transverse axis 562 of the housing for the augmenter 510. As with the embodiments in FIGS. 8–11, elements of this embodiment of the augmenter 510 are symmetrical at opposed sides of the axis 562. The widening of the sidewall 568 of the housing provides for an increased throw of the central link 516 so that the respective driven arms 530,536 will proceed along the direction of the arrows 574,576, respectively, wherein the arms 530,536 abut a corresponding region of the sidewall 568. Because the arms 530,536 have to travel further for abutment with the sidewall 568, there is an increase in throw over that which is provided with the embodiments at FIGS. 8–11.

Accordingly, from the above description, the mechanical advantage that is imparted by means of the augmenter wrench can be varied depending upon the relative lengths of the driven arms and the drive fingers engaging the driven arms. An equal length of the driven arms in relation to the drive fingers will produce a neutral mechanical advantage. A positive mechanical advantage will result if the lever arm of the drive finger is longer than the lever arm of the driven arm and vice versa, if it is shorter. In the Figures, the drive finger is shown shorter than the driven arm thereby reducing the torque provided to the drive sockets below the torque provided to the middle driven socket.

The device of the present invention not only can act as an effective tool for manually tightening a fastener up to a certain extent, but the device offers significant advantages when working with an impact tool in confined spaces or spaces having relatively low clearance. The device is relatively narrow at the drive socket to fit over a bolt, or for a socket to be placed within the drive aperture to engage a nut. When the impact tool engaged with the augmenter relaxes, or there is a lull in the torque cycle, the internal springs of the augmenter will force the driven arm to the extreme initial position and the cycle will repeat itself. The combination of the impact tool and the augmenting wrench will continue to cycle until the torque necessary to rotate the driven arm is greater than the torque that is exerted by the impact wrench. In effect, the device dead ends when the pressure of the spring on the drive collar will be insufficient to rotate the driven arm of the augmenter.

A drive arm is mounted for coaction with the ratchet and has a somewhat triangular shape extending toward a more central portion of the housing.

The distance between the drive socket and the driven aperture affords clearance so that an impact tool such as shown in FIG. 12, can be applied to the augmenter at a substantial offset distance from the fastener acted upon.

A continuous gasket extends along the surface area of each one of the halves where the halves contact each other to form the housing. The elements described with respect to FIGS. 8–11 are bathed in grease to provide lubrication and cooling during the highly repetitious movement of the elements when being driven by the impact wrench.

The movement of the impact wrench in the drive receptacle causes each one of the sockets to move in an opposite direction in the ratio of the lever arms. That is, the sockets will rotate at the opposite ratio of the mechanical advantage.

Figure 14:
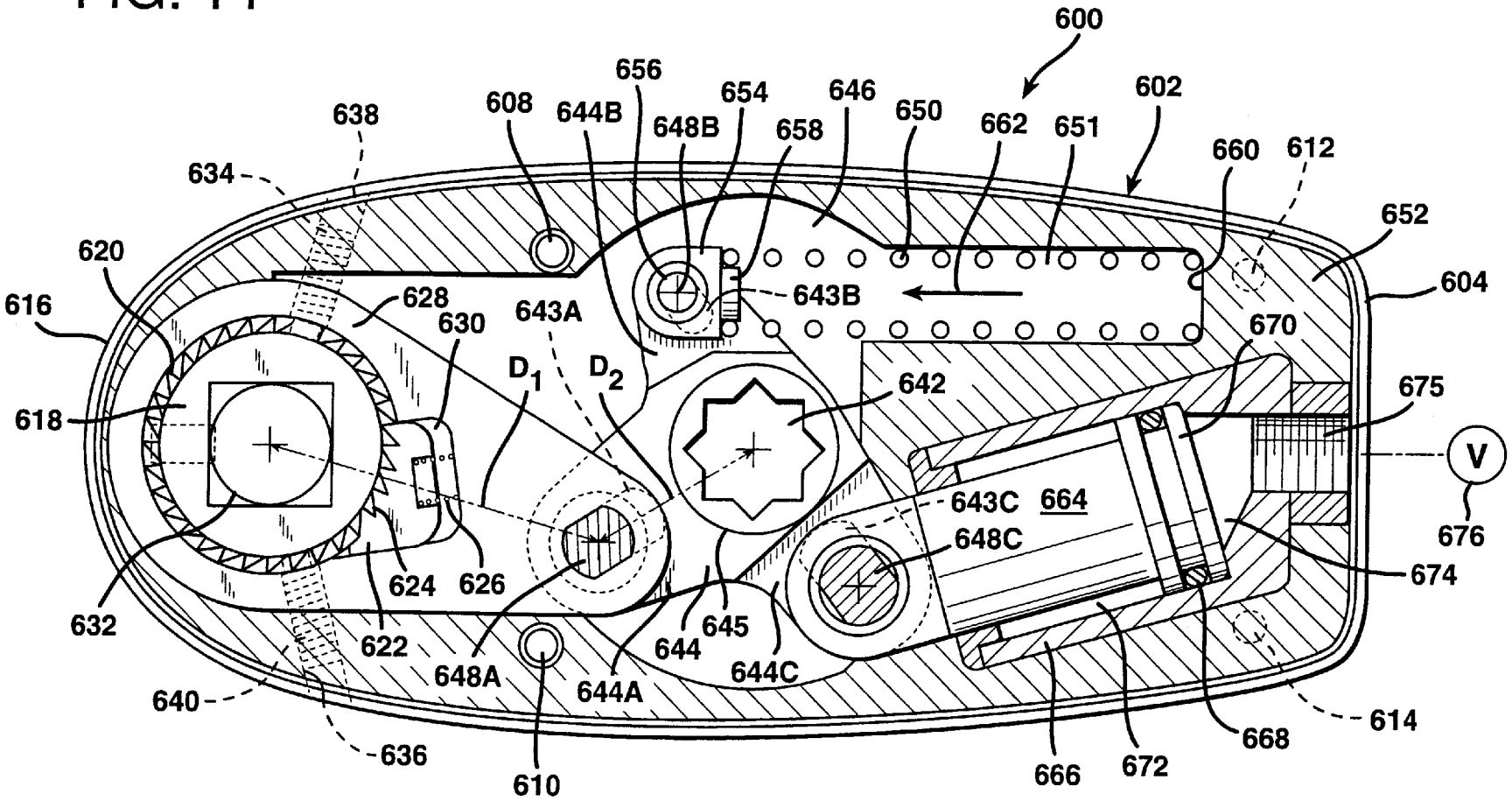
FIG. 14 is a top plan view showing an interior of another embodiment of the hand wrench according to the present invention.

In FIG. 14, another embodiment of a wrench having torque augmenting means is shown generally at 600. The housing 602 for the wrench is formed of two halves 604,606 (see also FIG. 17) for the bottom and top, respectively, which are held together with case screws positioned at 608–614. For reference purposes, a front end 616 of the wrench includes a ratchet 618 with teeth 620 and a pawl 622 with corresponding engaging teeth 624 mounted for coaction with each other. The pawl 622 is biased for coaction with the ratchet 68 by a spring 626. The pawl 622 and spring 626 are supported on a drive or lever arm 628 formed with a recess 630 to receive the pawl 622 and spring 626. The pawl and spring are adapted for coaction with the ratchet 618 during a torque operation. A drive or torque output 632 for this embodiment can be either a male drive element or a female drive element such as a socket.

The housing 602 is provided with at least one, and in a preferred construction, a pair of threaded bores 634,636 in each of which is inserted a corresponding pair of friction control screws 638,640 of this drag means for providing "drag" upon the ratchet 618. The friction control screws 638,640 of this drag means prevent the ratchet 618 from losing the initial torque obtained at the very beginning of a torque operation.

A drive or power input 642 is disposed substantially at a center of the housing 602. The drive input 642 is adapted to receive a male member, or can be fitted with an adapter to extend therefrom and receive the female drive member such as a socket.

A linking means 644 such as a reaction arm having three lobes 644A–C or ears is mounted to a circular bushing 645 supported at the drive input. The linking arm 644 turns at the bushing 645 in conjunction with movement of the drive input 642. A bottom floor 646 of the housing 602 is constructed and arranged to provide for movement of the linking arm 644 within the casing 602.

The drive output 632 and the drive input 642 are accessible from either side of the casing 602.

A connecting means such as a first pin 648A connects the first lobe 644A or transmission lobe of the linking arm 644 with the lever arm 628. A second pin 648B connects the second ear 644B or return lobe of the linking arm 644 to a compression spring 650 mounted in a receptacle 651 at an end 652 of the housing 602 substantially opposed to the end 616 of the housing in which the torque output 632 is arranged. The compression spring 650 includes a mounting plate 654 having an aperture 656 therethrough which is constructed and arranged to receive the second pin 648B and permit the second pin 648B to move during pivoting of the linking arm 644. A support stud 658 extends from the mounting plate 654 and is attached to an end of the compression spring 650. The opposite end of the compression spring, as mentioned above, is mounted at an interior of the housing 602 in the receptacle 651 as shown generally at 660. The compression spring 650 forces the linking arm 644 in the direction of arrow 662.

A third connecting means such as pin 648C connects a third one of the lobes 644C or power lobe of the linking arm 644 to piston means 664 or a plunger which extends into a cylinder 666 in the housing 602. A seal 668 extends around a head 670 of the piston 664.

A chamber 672 for the cylinder 666 is in communication with a passageway 674 leading to an inlet 675 which can be connected to a valve 676 or other hydraulic source/device external to the housing 602 for the wrench 600.

Slots 643A–C are provided for corresponding pins 648A–C to move therein during pivotal movement of the linking arm 644.

The arcuate guide bar 36, and ridges 62,66 and 64,67, and grooves 58,60 of FIGS. 2 and 3 can also be included in the embodiment shown in FIGS. 14–18, but are not shown in FIGS. 14–18 for purposes of clarity. These elements function similar to that disclosed and described with respect to FIGS. 2 and 3.

Figure 15:
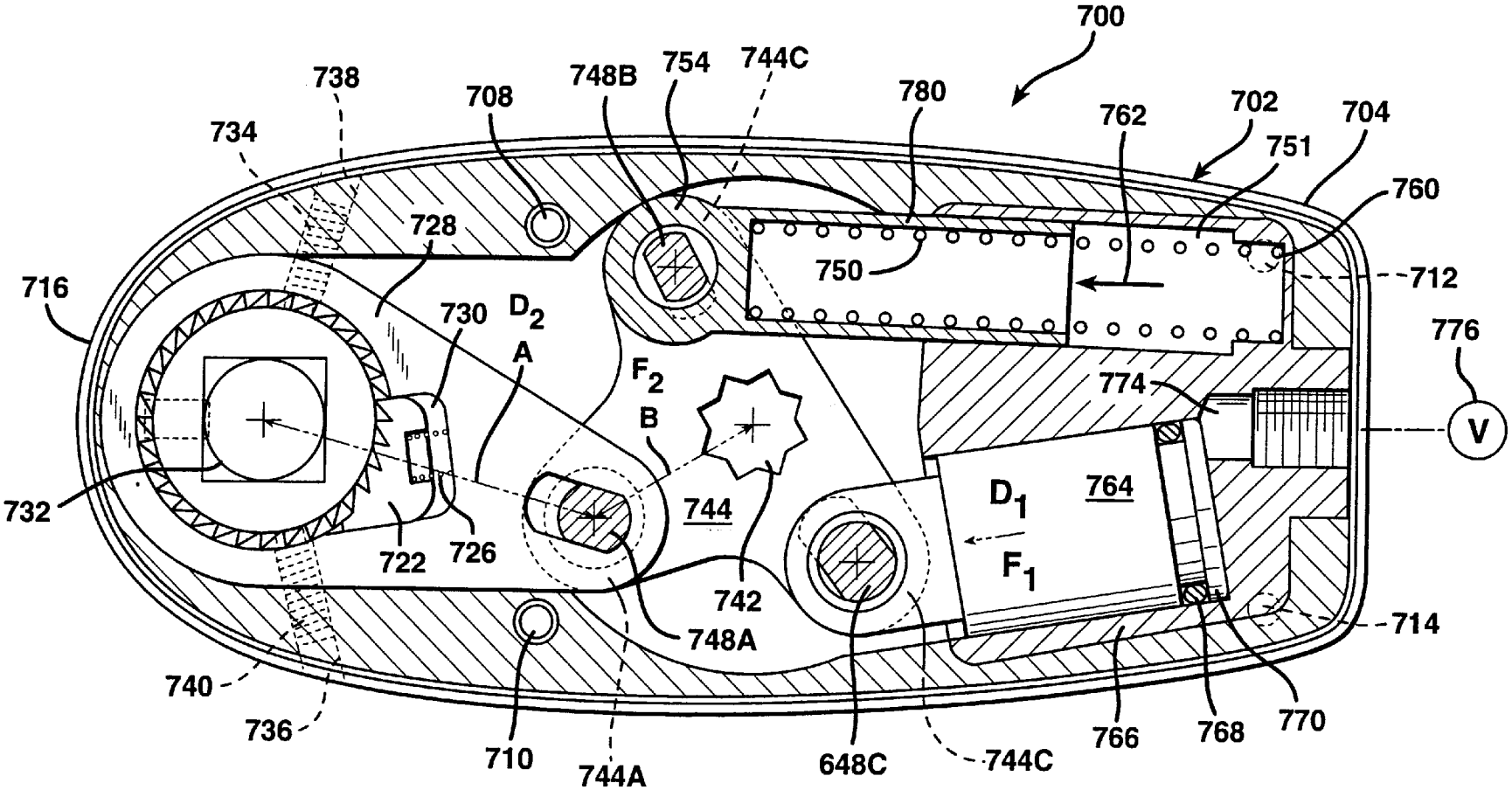
FIG. 15 is a top plan view showing an interior of still another embodiment of the hand wrench according to the present invention.

In operation, the wrench 600 is used by inserting a drive member into the power input 642 and torquing the input to pivot the linking arm 644 in a clockwise direction. Referring also to FIG. 15, this motion will accordingly force the drive arm 628 in a clockwise direction thereby providing the torque and permitting the teeth 624 of the pawl 622 to engage the ratchet teeth 620 and retain the next advanced position with respect to the ratchet 618.

Alternatively, if an impact wrench 380, such as that shown in FIG. 12, is inserted into the power input 642 for the wrench 600 of the present invention, the repetitive cycling of the impact wrench 380 will provide the necessary torquing strokes. The spring 650 will force the linking arm 644 in a counter clockwise direction upon termination of each stroke during the lull or slip of the impact wrench 380.

The power input 642 can be bypassed in those instances where a hydraulic line is connected to the valve 676 of the wrench 600, thereby employing the piston 664 to force the linking arm 644 in a clockwise direction against the spring 650. After completion of the stroke of the linking arm 644, the brief interval of slip permits the spring 650 to bias the linking arm 644 in a counter clockwise direction to reset for a subsequent torquing stroke.

Torque output for the wrench shown in FIG. 14 is determined by the ratio of the distances D1 and D2. The 2:1 ratio corresponds to the distance indicated at D1 with respect to the distance at D2, thereby providing the 2:1 ratio for torque input to torque output.

Figure 16:
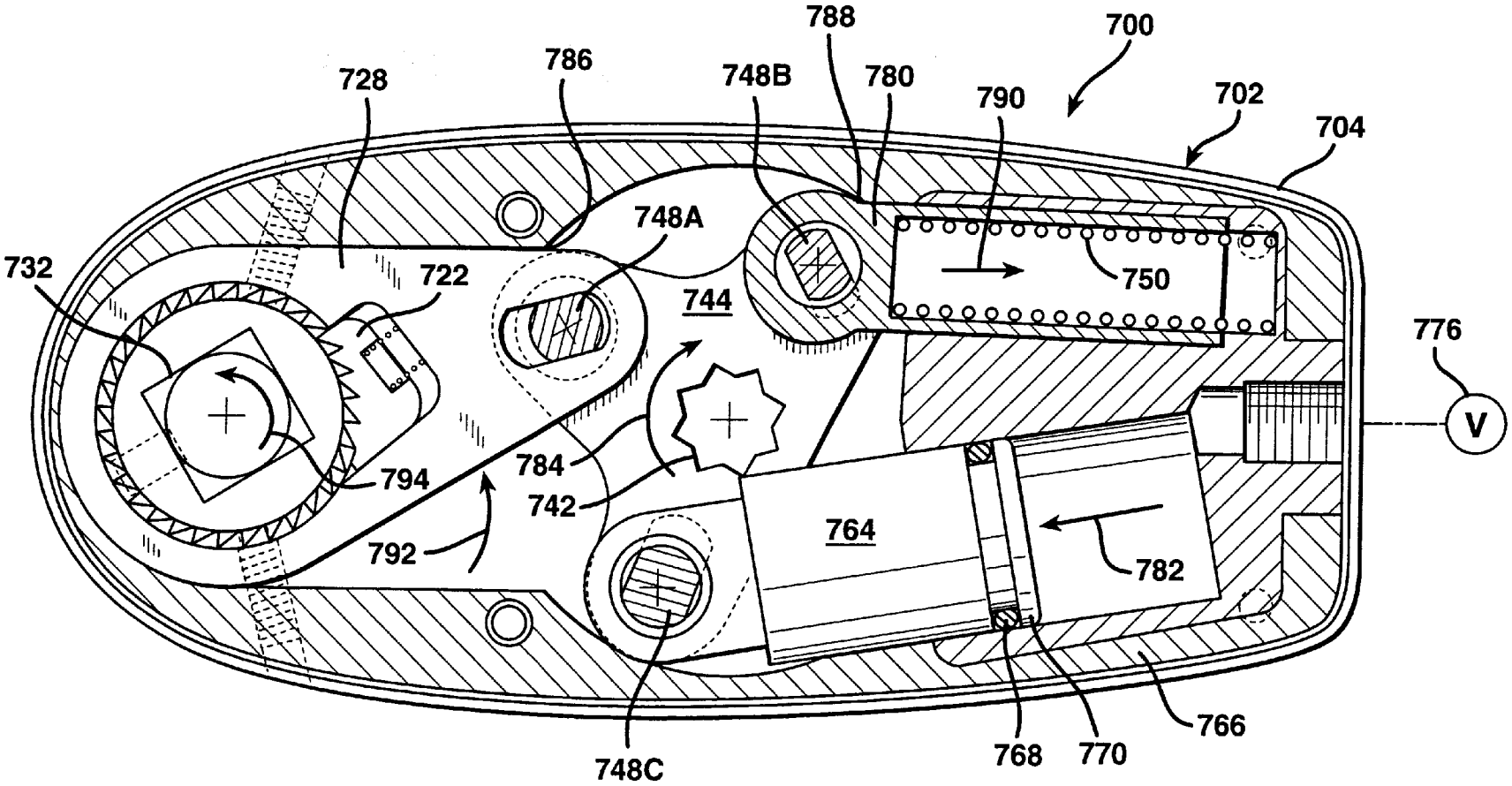
FIG. 16 is a top plan view of the embodiment shown in FIG. 15 upon conclusion of a torque stroke of the present invention.

In FIGS. 15 and 16, another embodiment of the wrench shown in FIG. 14 is disclosed. In this embodiment, the elements are referred to by numbers increased by 100 so that the wrench is shown generally at 700. All of the elements operate substantially the same as those disclosed in FIG. 14, unless otherwise stated. A cylinder 766 for the piston 764 is modified to receive and retain the spring 750. In this manner of construction, the spring 750, piston 764 and cylinder 766 are assembled as a unit in the housing 702 for the wrench 700.

The torque output provided by the wrench as shown in FIG. 15 is obtained from the formula, torque output=(F1×D1)÷(F2×D2) where:

F1 is the force applied at the piston 764;

D1 is the distance traveled by the piston 764;

F2 is the force applied to the reaction arm 744; and

D2 is the distance that the drive arm 728 travels.

In FIG. 15, the compression spring 750 is mounted at one end in the cylinder 766 at 760. An opposite end of the spring is received in a sleeve 780 or a collar which extends to the mounting plate 754 through which the second pin 748B is disposed. The construction of the spring 750 and piston 764 arranged in the same cylinder 766 provides for more stable torquing and recoiling operations, and a reduction in vibration under extreme pressures. FIGS. 15 and 16 show the beginning (FIG. 15) position of the wrench 700 according to the present invention as it proceeds through a first stroke (FIG. 16) just prior to the subsequent slip that would occur if used with an impact wrench (FIG. 12), or the return of a hand operated device at the power input 742 for another subsequent stroke of torquing force.

Referring to FIG. 16 in conjunction with FIG. 15, there is shown movement of the piston 764 in the direction of arrow 782 to force the linking arm 744 in the direction of arrow 784. As the linking arm turns clockwise all the way to the stops 786,788, the sleeve 780 is forced in the direction of the arrow 790 so that the spring 750 is compressed in the cylinder 766.

During the pivoting of linking arm 744, it can be seen that the drive arm 728 is pivoted in the direction of the arrow 792 until the drive arm 728 contacts the stop 786 in the housing 702. As the drive arm 728 turns, the teeth 724 of the pawl 722 are biased into engagement with the teeth 720 of the ratchet 718 to provide for a torque stroke at the drive output 732. Accordingly, the drive output 732 turns in the direction of the arrow 794.

Figure 17:
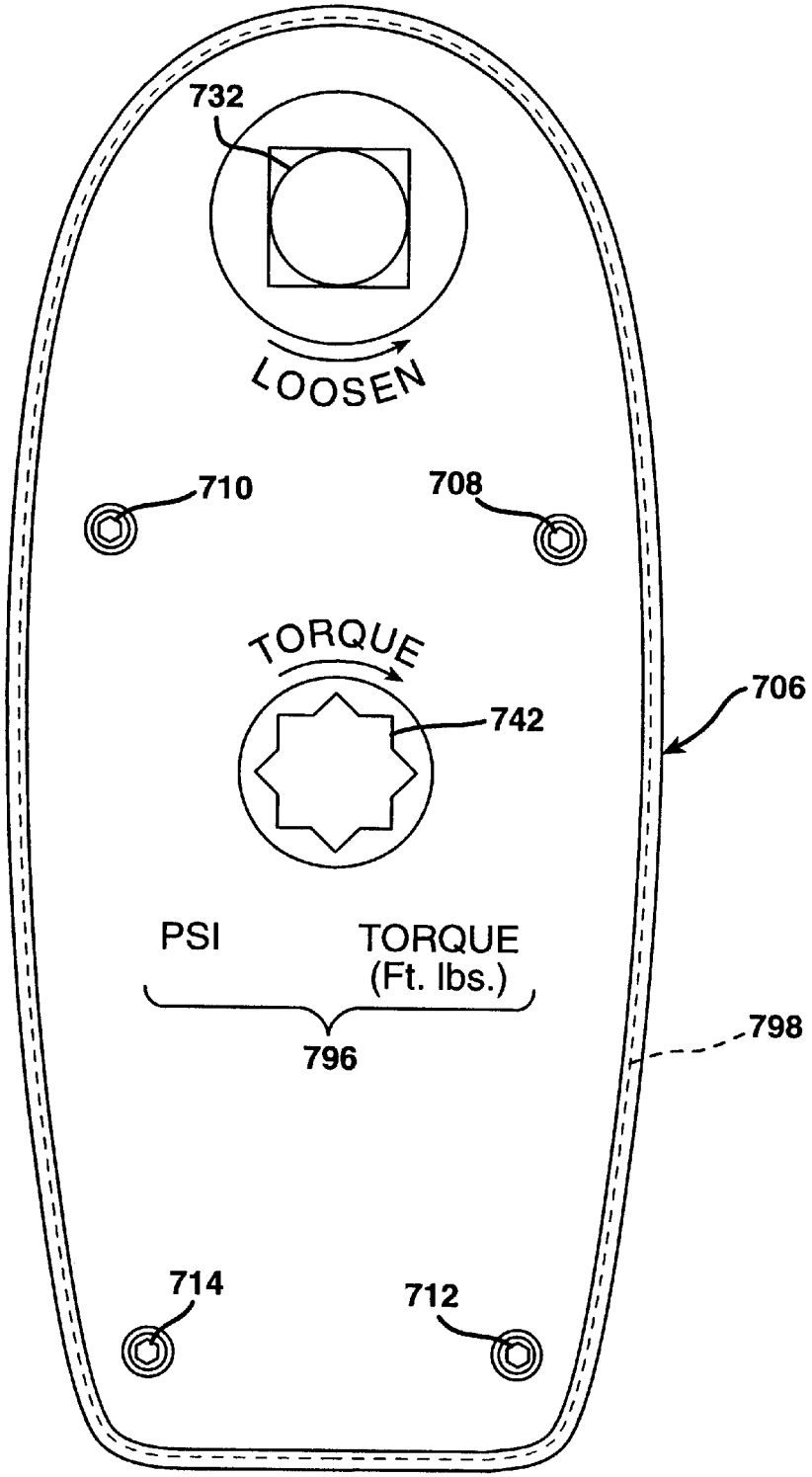
FIG. 17 is a top plan view of a cover for a casing for the embodiments shown in FIGS. 14–16.

FIG. 17 shows a cover 706 or the other half of the housing 702 for the wrench 700 shown in FIGS. 15 and 16. This cover 706 can also be used with the embodiment shown in FIG. 14. A legend or table of the relationship of the PSI and TORQUE (foot lbs.) is shown generally at 796 and is provided on the cover for purposes of cross-referencing during the torque operation. A broken line 798 indicates the position of a gasket used when the halves of the housing are joined together.

Figure 18:
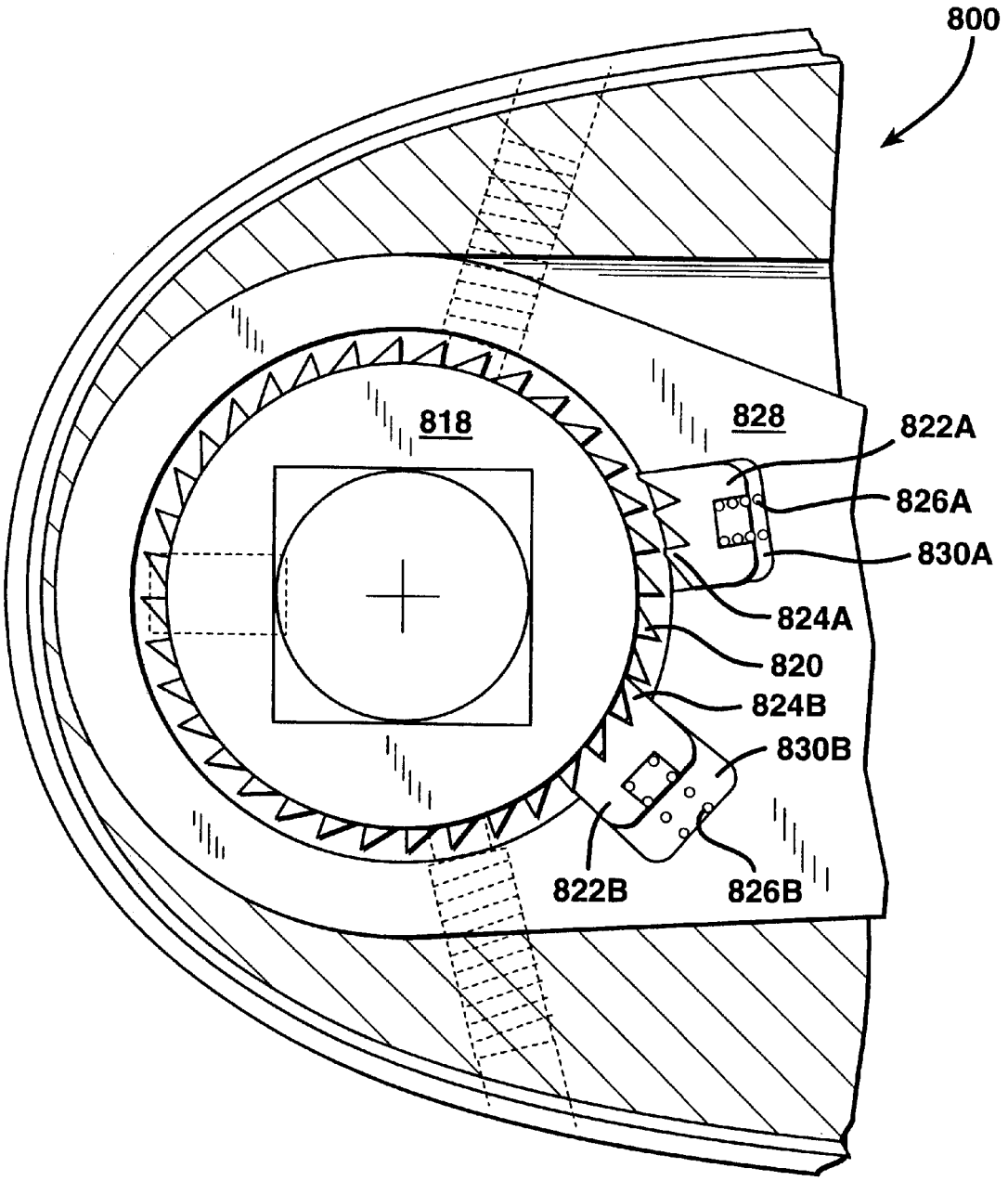
FIG. 18 is a partial top view of a dual-pawl and ratchet assembly for the wrench according to the present invention.

FIG. 18 shows a dual-pawl assembly for another embodiment of the present invention. In this arrangement, pawls 822A,822B are of similar construction and have corresponding teeth 824A,824B. The pawls are disposed in respective recesses 830A,830B of the drive arm 828. The pawls 822A,B include springs 826A,B to be biased with respect to the ratchet teeth 820. It is preferred that when the teeth 824B of, for example, the pawl 822B have engaged the corresponding teeth 820 of the ratchet 828, the teeth 824A of the pawl 822A are no more than half way into engagement with corresponding teeth 820 of the ratchet 818. With this arrangement, as the torquing continues, and the pawls teeth 824B are extracted, the other pawls teeth 824A move into close engagement with the ratchet teeth 820 to prevent any loss of torque already obtained. In all other aspects, the elements and operations thereof are the same as those shown with respect to FIGS. 14–16.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A method of tightening a fastener, the method comprising the steps of:

engaging a drive head of a wrench having a handle with a fastener to be tightened;

rotating the handle manually to turn the drive head to tighten the fastener to a first amount of torque;

maintaining the housing in a stationery position;

rotating a linkage means within the handle and coacting with the drive head to rotate the drive head to tighten the fastener to a second torque value higher than the first value of torque; and rotating the linkage means by means of hydraulic action located within the handle.

2. The method according to claim 1, where the step of rotating the handle manually further includes the sub-step of:

rotating the handle manually through several passes using ratchet means in the handle coacting with the engaging drive head.

3. The method according to claim 2, where the step of rotating the linkage means within the handle further includes the sub-step of:

rotating a driven socket in the handle coacting with the linkage means.

4. The method according to claim 3, further including the step of:

rotating the driven socket through several passes without movement of the handle by coaction between the driven socket and the ratchet in the housing.

5. The method according to claim 4, further including the step of:

maintaining the handle of the wrench in a stationary position during actuation of the hydraulic means within the handle.

6. The method according to claim 5, further including the step of:

rotating the linkage means back to an initial position upon relaxation of the force rotating the linkage means.

7. A wrench with torque augmenting means, comprising:

a housing including:

a top and a bottom, a first guide bar extending from the top, a second guide bar extending from the bottom toward the first guide bar;

torque output means in the housing, the torque output means including:

a drive output comprising:

a socket, a ratchet having teeth, drag means for coaction with the ratchet, the drag means including:

at least one screw threadably mounted in the housing for contacting the ratchet to apply drag thereon;

a lever arm about the torque output means having:

a first recess formed in the lever arm facing the ratchet, a second recess formed in the lever arm facing the ratchet, the second recess separate and discrete from the first recess and at a different pitch therefrom with respect to the ratchet, a first spring biased pawl mounted in the first recess of the lever arm for coaction with teeth of the ratchet;

a second spring biased pawl mounted in the second recess of the lever arm for coaction with teeth of the ratchet, the second pawl at a pitch with respect to the ratchet which is different than the pitch of the first pawl;

a first connecting pin extending from an end of the lever arm;

power input means in the housing, the power input means including:

an input socket for coaction with an external drive means, a cylinder, an inlet passage in the housing communicating with the cylinder and an exterior of the housing to hydraulically connect the cylinder to a source of hydraulic pressure exterior to the housing, a valve communicating with the inlet passage, a piston in the cylinder, the piston including:

a piston head, a seal at the piston head, and a second connecting pin extending from a bottom of the piston opposite to the piston head;

spring return means in the housing, the spring return means including:

a receptacle constructed and arranged in the cylinder, a spring disposed in the receptacle, and a third connecting pin extending from an end of the spring;

means for linking the power input means with the torque output means and the spring return means, the linking means disposed in the housing and including:

a reaction link having:

a transmission lobe extending from the reaction link and having a first slot therein for receiving the first connecting pin of the lever arm, a power lobe extending from the reaction link and having a second slot therein for receiving the second connecting pin of the piston, a return lobe extending from the reaction link and having a third slot therein for receiving the third connecting pin of the spring;

means for mounting the linking means in the housing, the mounting means comprising:

a circular bushing mounted in the housing about the input socket;

a seal disposed between the top and bottom of the housing to seal the housing;

wherein the linking means is pivotable within the housing without movement of the housing during a torque operation.

8. A wrench with torque augmenting means comprising:

a housing;

power input means in the housing;

torque output means in the housing;

return means in the housing;

means for linking the power input means, the torque output means, and the return means, the linking means disposed in the housing and comprising:

a four function link movable independently of the housing for providing cooperative movement between the power input means, the torque output means, and the return means, the four function link comprising:

a dual power input including an input socket accessible at opposed sides of the housing for coaction with a power source external to the housing, and a hydraulic assembly in the housing in communication with a hydraulic source external to the housing;

a single transmission output for torque; and spring return means.

9. The wrench according to claim 8, wherein the hydraulic assembly comprises:

a cylinder in the housing;

an inlet passage in the housing in communication with the cylinder and an outside of the housing to hydraulically connect to the external hydraulic source; and a piston in the cylinder, a bottom of the piston extending away from the inlet passage.

10. The wrench according to claim 9, further comprising:

a valve in communication with the inlet passage.

11. The wrench according to claim 8, wherein the single transmission output for torque comprises:

a drive output;

a ratchet mounted at the drive output;

a lever arm extending around the drive output for coaction therewith, the lever arm having a first recess formed therein in facing relationship with the ratchet; and a first pawl mounted in the first recess and spring biased for coaction with the ratchet.

12. The wrench according to claim 11, further comprising:

a second recess formed in the lever arm in facing relationship with the ratchet, the second recess separate and discrete from the first recess and at a different pitch with respect to the ratchet; and a second pawl mounted in the second recess and spring biased for coaction with the ratchet at a different pitch than the first pawl.

13. The wrench according to claim 12, wherein at least one tooth from one of the first or second pawls is always in engagement with the ratchet.

14. The wrench according to claim 11, further comprising:

drag means for producing drag on the ratchet.

15. The wrench according to claim 14, wherein the drag means comprises:

at least one screw threadably extending in the housing for engagement with the ratchet to produce drag thereon.

16. The wrench according to claim 11, wherein the lever arm further comprises:

pivotal connecting means for connecting the lever arm to the four function link.

17. The wrench according to claim 8, wherein the return means comprises:

a spring receptacle in the housing, a spring disposed in the spring receptacle, and spring connecting means extending from the spring in the housing to the linking means.

18. The wrench according to claim 17, further comprising:

a sleeve sized and shaped to receive the spring and move within the spring receptacle, the sleeve supporting the spring connecting means in the housing.

19. The wrench according to claim 18, wherein the spring connecting means is a pin connected to the linking means.

20. The wrench according to claim 8, wherein the power input means and the return means are constructed as a single assembly.

21. The wrench according to claim 8, wherein the four function link further comprises:

a power lobe extending from the four function link for connection with the power input means;

a return lobe extending from the four function link for connection with the return means; and a transmission lobe extending from the four function link for connection with the single transmission output for output.

22. The wrench according to claim 8, wherein the housing further comprises:

a top portion;

a bottom portion; and a seal constructed and arranged to be disposed between the top and bottom portions to seal the housing.

* * * * *